US009725262B2

(12) United States Patent
Otsuka

(10) Patent No.: US 9,725,262 B2
(45) Date of Patent: Aug. 8, 2017

(54) RECORDING APPARATUS

(71) Applicant: SEIKO EPSON CORPORATION, Tokyo (JP)

(72) Inventor: Kazuo Otsuka, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/832,563

(22) Filed: Aug. 21, 2015

(65) Prior Publication Data

US 2016/0059593 A1 Mar. 3, 2016

(30) Foreign Application Priority Data

Aug. 29, 2014 (JP) ..... 2014-175123
Apr. 16, 2015 (JP) ..... 2015-083973

(51) Int. Cl.
*B41J 11/00* (2006.01)
*B65H 1/26* (2006.01)

(52) U.S. Cl.
CPC ..... *B65H 1/266* (2013.01); *B65H 2511/10* (2013.01); *B65H 2511/20* (2013.01); *B65H 2511/30* (2013.01); *B65H 2511/52* (2013.01); *B65H 2553/414* (2013.01)

(58) Field of Classification Search
CPC ... B41J 11/003; B41J 11/0025; B41J 11/0045; B41J 11/0055
See application file for complete search history.

(56) References Cited

U.S. PATENT DOCUMENTS

2006/0045601 A1* 3/2006 Endo ..... B41J 13/103 400/642
2006/0091599 A1* 5/2006 Okuda ..... B41J 11/0025 271/248
2010/0166484 A1* 7/2010 Edwards ..... B41J 11/003 400/642
2011/0076080 A1* 3/2011 Hirate ..... B41J 11/0025 400/582
2014/0153046 A1 6/2014 Kuwano

FOREIGN PATENT DOCUMENTS

JP 2008-114973 A 5/2008
JP 2014-108585 A 6/2014

* cited by examiner

*Primary Examiner* — Jason Uhlenhake
(74) *Attorney, Agent, or Firm* — Workman Nydegger

(57) ABSTRACT

A printer includes a lower tray and an upper tray provided above the lower tray. Each tray is provided with an edge guide that is displaceable according to the sheet size and that guides an edge of sheets. A guide sensor capable of detecting the distance to each edge guide is spaced from the edge guide by a gap in the displacement direction of the edge guide.

11 Claims, 24 Drawing Sheets

RECORDING APPARATUS

BACKGROUND

1. Technical Field

The present invention relates to a recording apparatus that includes a recording medium housing portion that houses a recording medium.

2. Related Art

Recording apparatuses represented by facsimiles, printers, etc. have widely used sheet feeder cassettes (sheet feeder trays) that are detachably attachable to apparatus bodies. Among such sheet feeder cassettes there is one which includes a movable guide that guides edges of sheets housed in the tray and which is configured to detect the position of the movable guide and therefore recognize the size of the sheets housed in the tray as disclosed in JP-A-2008-114973.

In a sheet guide apparatus described in JP-A-2008-114973, a sensor is provided at a location that corresponds to a predetermined size position, and when the movable guide is shifted to the predetermined size position, the sensor detects the shift of the movable guide. In this manner, the sheet guide apparatus is able to determine that sheets of the predetermined size have been housed. However, detected portions that the sensor detects need to be provided separately for each size, resulting in a complicated configuration.

SUMMARY

An advantage of some aspects of the invention is that the recording apparatus of the invention is capable of detecting the size of sheets within a sheet housing section while having a simple configuration that does not include detected portions provided separately for each size. Another advantage is that the recording apparatus is capable of detecting whether the quantity of sheets within the sheet housing section is large or small, in addition to more appropriately detecting the size of sheets within the sheet housing section.

According to an aspect of the invention, a recording apparatus includes a recording unit that performs recording on a medium, a medium housing section that houses the medium, an edge guide that is provided in the medium housing section, that is displaceable according to a size of the medium, and that guides an edge of the medium, a detection unit that is spaced from the edge guide by a gap in a displacement direction of the edge guide and that detects a distance to the edge guide, and a computation unit that computes a position of the edge guide based on a result of detection by the detection unit.

According to this aspect of the invention, since the recording apparatus includes the detection unit that is spaced from the edge guide by a gap in the displacement direction of the edge guide and that detects the distance to the edge guide and the computation unit that computes the position of the edge guide based on a result of detection by the detection unit, the recording apparatus is able to recognize the position of the edge guide within the medium housing section based on the detected distance. In consequence, the sizes of various media can be recognized. Therefore, the recording apparatus is able to detect the size of the medium in the medium housing section while having a simple construction.

In the first aspect of the invention, the edge guide may be displaceable in a direction that intersects a feeding direction of the medium.

According to this construction, the size of the medium in the direction that intersects with the feeding direction of the medium can be detected.

Furthermore, the edge guide may be displaceable in the feeding direction of the medium.

According to this construction, the recording apparatus can detect not only the medium's size in the direction that intersects the feeding direction of the medium but also the medium's size in the feeding direction of the medium. Therefore, the recording apparatus is able to detect the sizes of media defined by individual users (user-defined sizes).

In the foregoing aspect of the invention, the detection unit may be an optical sensor.

According to this construction, since the detection unit is an optical sensor, that is, a non-contact type detection unit, breakage of the detection unit in conjunction with attachment or detachment of the medium housing section, if the medium housing section is of a detachably attachable type, can be restrained.

In the foregoing construction, the medium housing section may be detachably attachable to an apparatus body that includes the recording unit, the detection unit may be provided on the apparatus body, a sidewall of the medium housing section may be provided with a light passing portion that lets detection light from the optical sensor pass, and the detection unit may detect the distance to the edge guide in the medium housing section via the light passing portion of the sidewall.

According to this construction, since the detection unit is provided not on the detachably attachable medium housing section side but on the apparatus body side, an electrical wiring path between the detection unit and a control unit provided in the recording apparatus can be easily constructed.

The light passing portion may be made up of a cutout or a hole.

According to this construction, since the light passing portion is made up of a cutout or a hole, it is possible to make the light passing portion in a simple construction while restraining cost increases.

Furthermore, the detection unit may be provided on a sidewall of the medium housing section.

According to this construction, since the detection unit is provided on the side wall of the medium housing section, the detection unit can be disposed at a position near the edge guide, so that high detection accuracy can be achieved in the detection of the distance between the edge guide and the detection unit.

Still further, the edge guide may be provided with a light passing portion that lets detection light from the optical sensor pass, and the detection unit may be capable of detecting the edge of the medium via the light passing portion of the edge guide.

According to this construction, since the edge guide is provided with the light passing portion that lets the detection light from the optical sensor pass and the detection unit is capable of detecting the edge of the medium via the light passing portion of the edge guide, the recording apparatus is able to detect not only the position of the edge guide, that is, the size of the medium, but also whether the quantity of the medium is large or small. That is, both the size and the quantity of the medium can be detected by using one detection unit, so that the costs of the recording apparatus can be reduced.

Further, the recording apparatus according to the foregoing aspect of the invention may further include a feed roller that feeds out the medium from the medium housing section, the feed roller may be provided on a pivotable pivot member and may advance toward and withdraw from a bottom surface of the medium housing section as the pivot member pivots, and the detection unit may be provided on the pivot member.

According to this construction, since the detection unit is provided not on the side of the detachably attachable medium housing section but on the size of a body of the recording apparatus, electrical wiring between the detection unit and a control unit of the recording apparatus can be easily made.

Furthermore, the detection unit may be provided at such a position as to be able to face a guide surface of the edge guide when the medium is housed up to an upper-limit height in the medium housing section to which the medium is allowed to be housed in the medium housing section.

According to this construction, since the detection unit is provided at such a position as to be able to face the guide surface of the edge guide when the medium is housed up to the upper-limit height to which the medium can be housed in the medium housing section, the recording apparatus is able to detect the distance between the detection unit and the edge guide, regardless of the quantity of the medium in the medium housing section.

Furthermore, the edge guide may be provided with a light passing portion provided so that a rate of passage of the detection light from the optical sensor via the light passing portion changes in a medium loading direction.

According to this construction, since the edge guide is provided with the light passing portion provided so that the rate of passage of the detection light from the optical sensor via the light passing portion changes in the medium loading direction, the recording apparatus is able to detect, using the light passing portion, not only the position of the edge guide, that is, the size of the medium, but also whether the quantity of the medium is large or small. That is, both the size and the quantity of the medium can be detected by using one detection unit, so that the costs of the apparatus can be reduced.

Further, the recording apparatus according to the foregoing aspect of the invention may include a plurality of the medium housing section, and the edge guide provided in each of the plurality of the medium housing section may be detected by a single one of the detection unit.

According to this construction, since a plurality of medium housing sections are provided and the edge guides provided in the medium housing sections are detected by using one detection unit, the costs of the recording apparatus can be reduced.

Furthermore, a reflection rate of the detection light emitted from the optical sensor to the edge guide with respect to the edge guide may vary from one medium housing section to another among the plurality of the medium housing section.

According to this construction, since a plurality of medium housing sections are provided and the reflection rates of the detection light emitted from the optical sensor to the edge guides with respect to the edge guides vary from one medium housing section to another, the recording apparatus is able to recognize to which one of the medium housing sections a detected edge guide belongs, based on the reflection intensity of the detection light, so that more appropriate feeding control can be carried out.

Furthermore, a control unit that receives detection information from the detection unit may output a predetermined alert when the detection unit does not detect the edge guide.

According to this construction, since the control unit that receives the detection information from the detection unit outputs an alert when the edge guide is not detected, the recording apparatus is able to carry out a smooth and appropriate feeding operation by prompting the user to check the state inside the medium housing section.

Further, a control unit that receives detection information from the detection unit may output a predetermined alert when the distance between the edge guide and the detection unit exceeds a predetermined range.

According to this construction, since the control unit that receives the detection information from the detection unit outputs an alert when the distance between the edge guide and the detection unit exceeds the predetermined range, the recording apparatus is able to carry out a smooth and appropriate feeding operation by prompting the user to check the state inside the medium housing section.

BRIEF DESCRIPTION OF THE DRAWINGS

FIG. 19A shows a state in which sheets have been housed up to an upper-limit height, FIG. 19B shows a state in which the quantity of sheets has reduced to half the upper-limit height.

DESCRIPTION OF EXEMPLARY EMBODIMENTS

Exemplary embodiments of the invention will be described hereinafter with reference to the drawings. The following description of exemplary embodiments of the invention is based on a premise that the invention is not limited to the exemplary embodiments described below, but can be changed in various manners within the scope of the invention described in the appended claims and that such changes are also within the scope of the invention.

Figure 1:
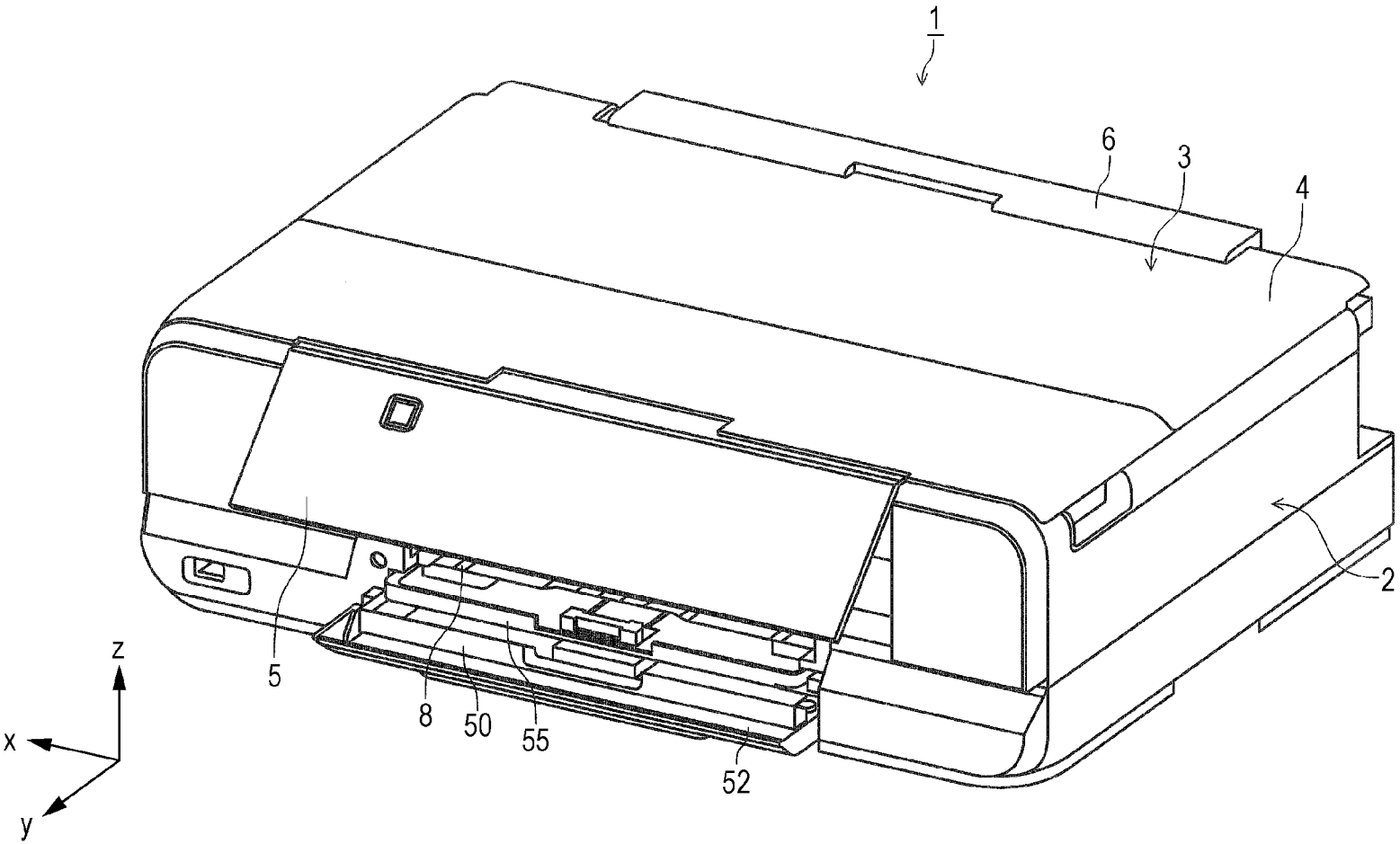
FIG. 1 is an external perspective view of a printer according to the invention.
Figure 2:
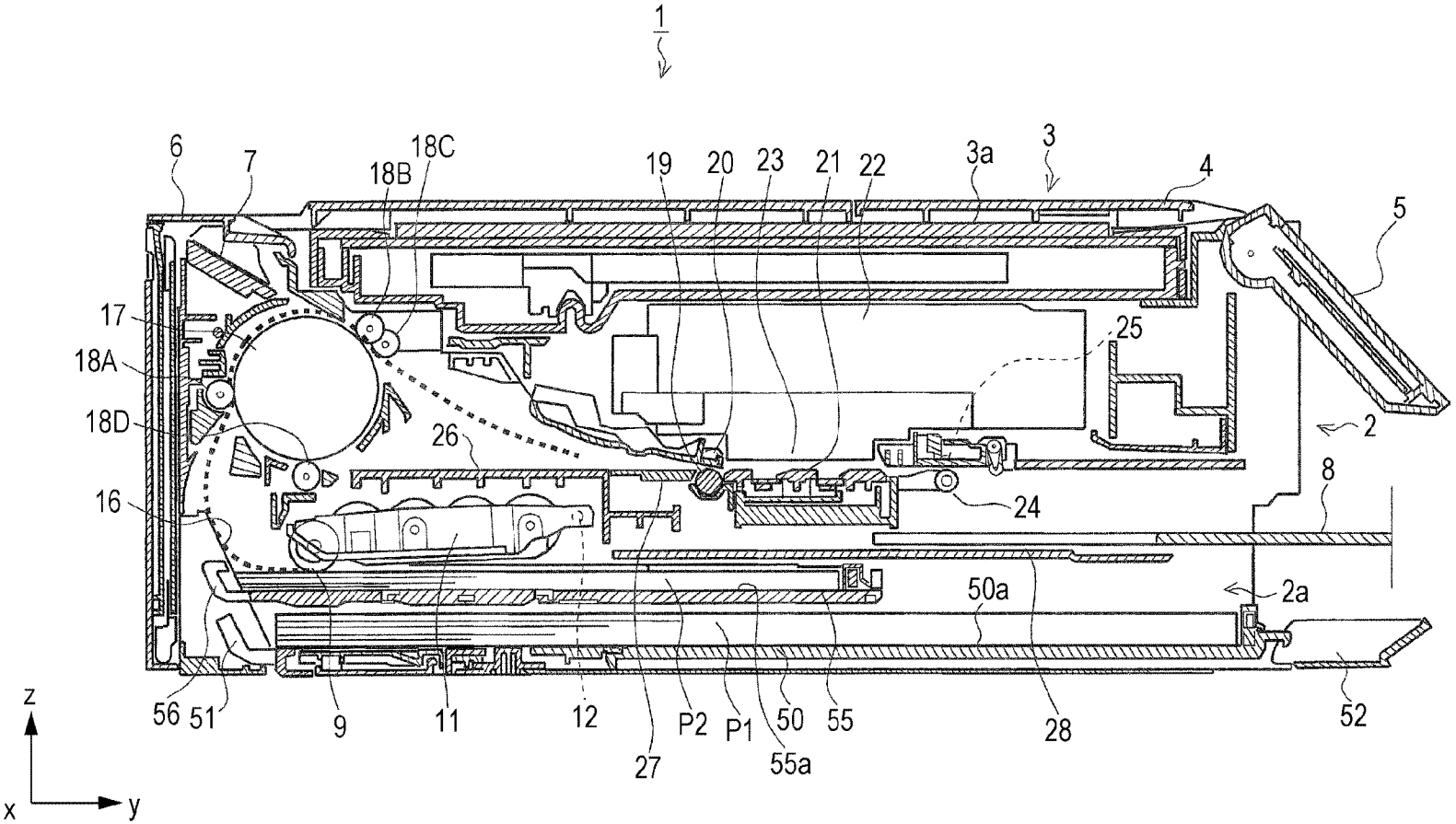
FIG. 2 is a side sectional view showing a sheet transport path of the printer according to the invention.
Figure 3:
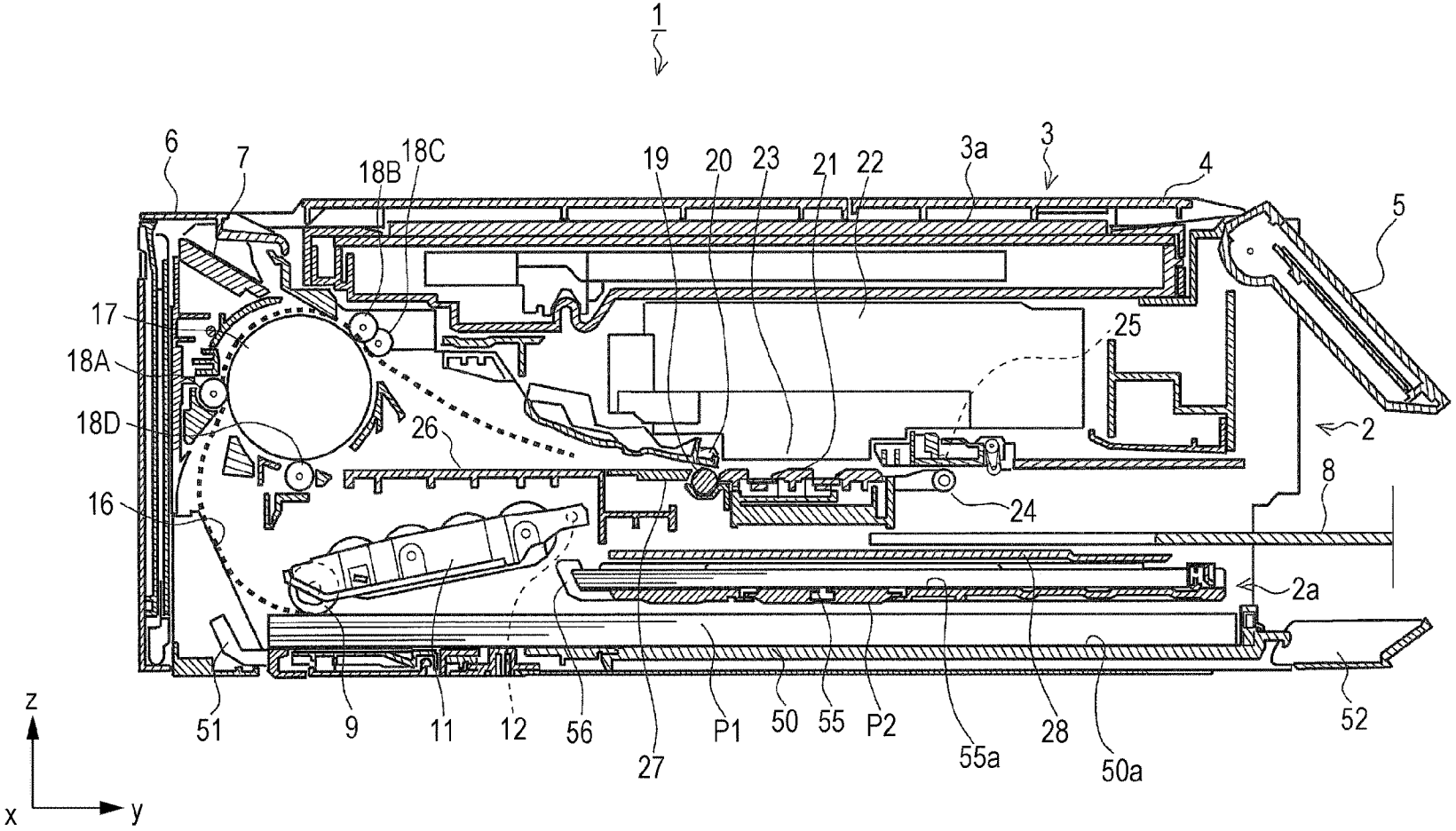
FIG. 3 is a side view showing the sheet transport path of the printer according to the invention.
Figure 4:
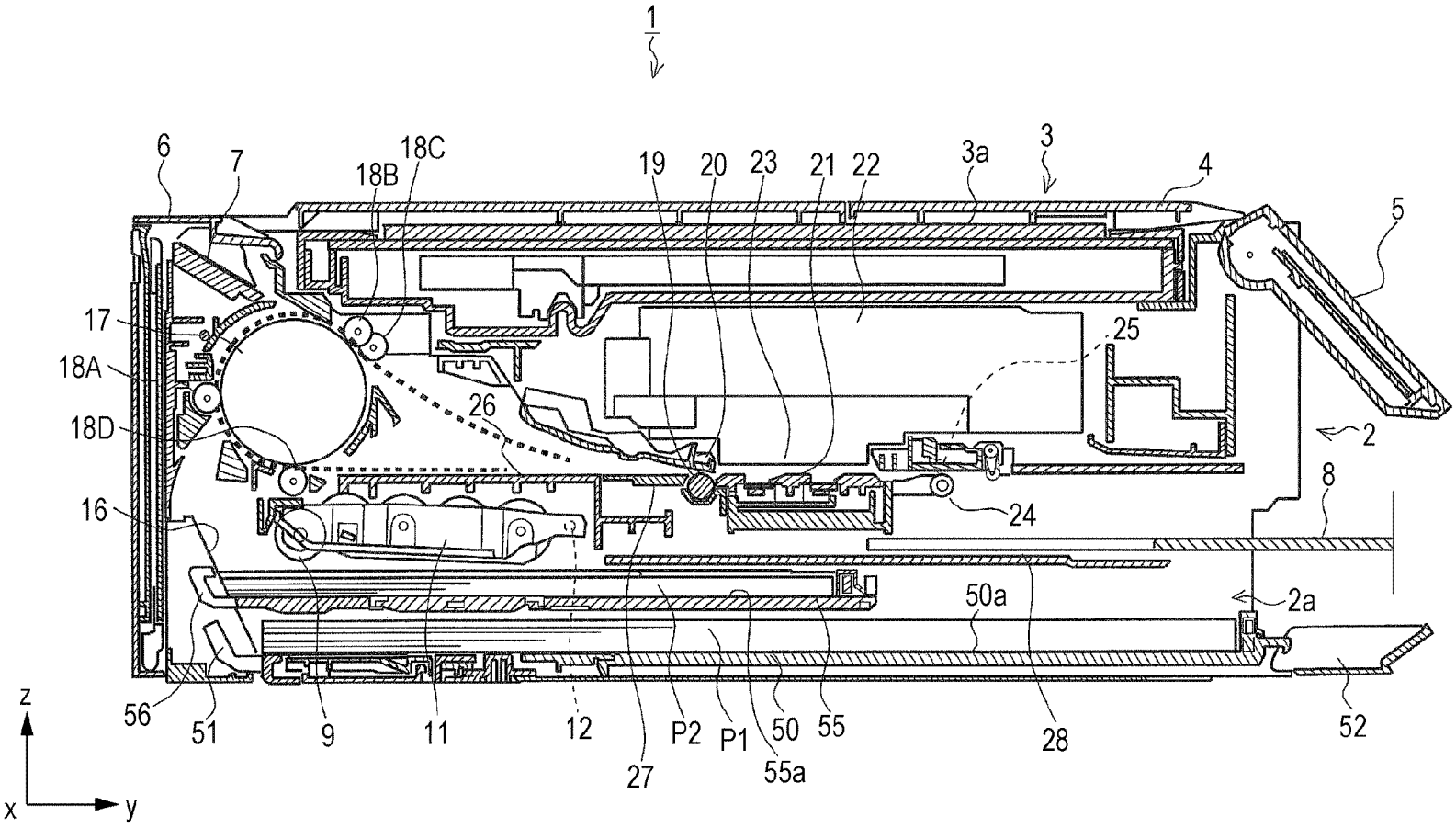
FIG. 4 is a side sectional view showing the sheet transport path according to the printer of the invention.
Figure 5:
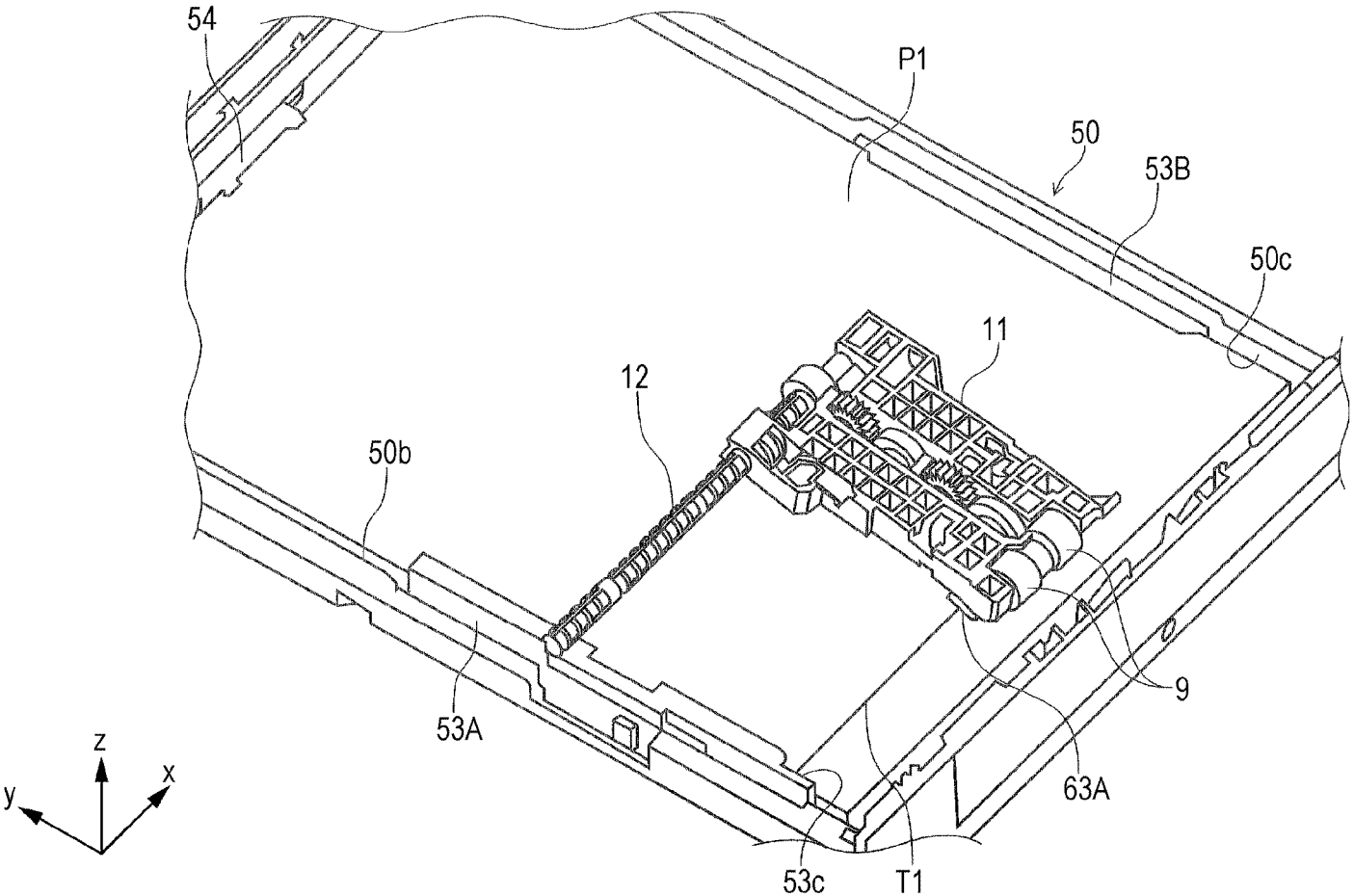
FIG. 5 is a perspective view showing a lower tray, a roller support member, and an edge guide sensor.
Figure 6:
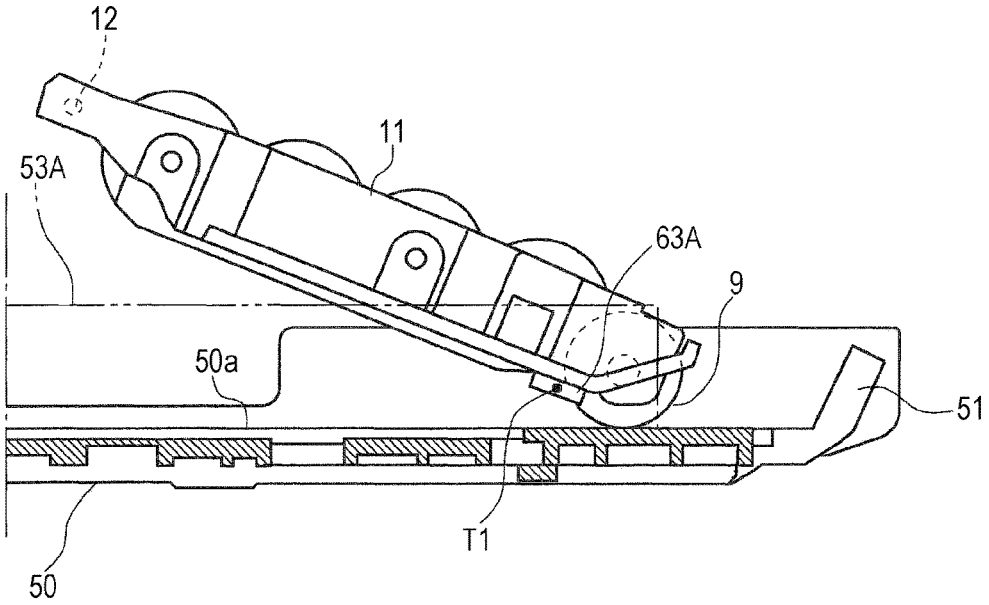
FIG. 6 is a side sectional view showing the lower tray with no sheet in the lower tray.
Figure 7:
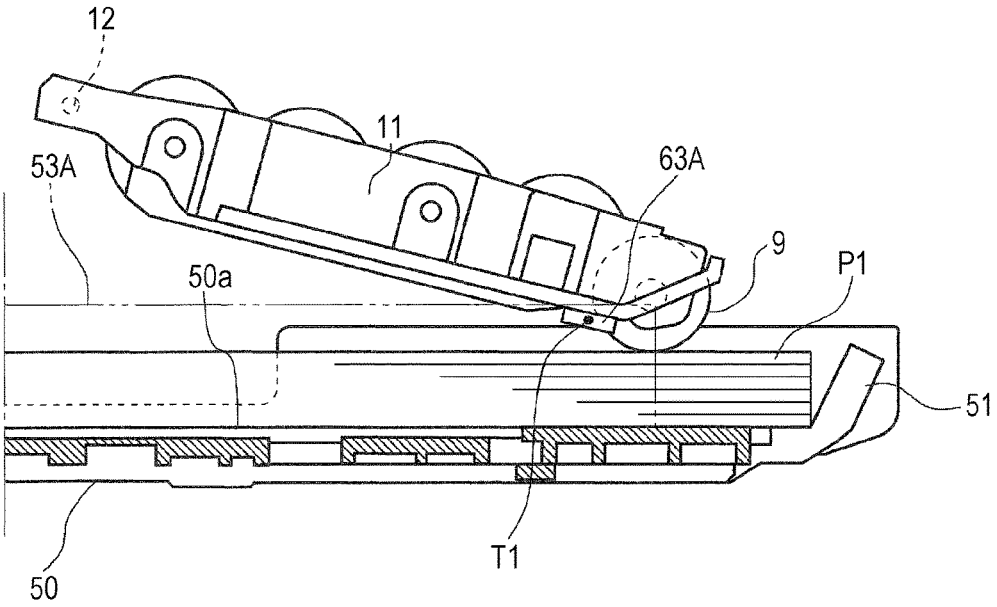
FIG. 7 is a side sectional view showing the lower tray in which sheets have been housed up to an upper-limit height.
Figure 8:
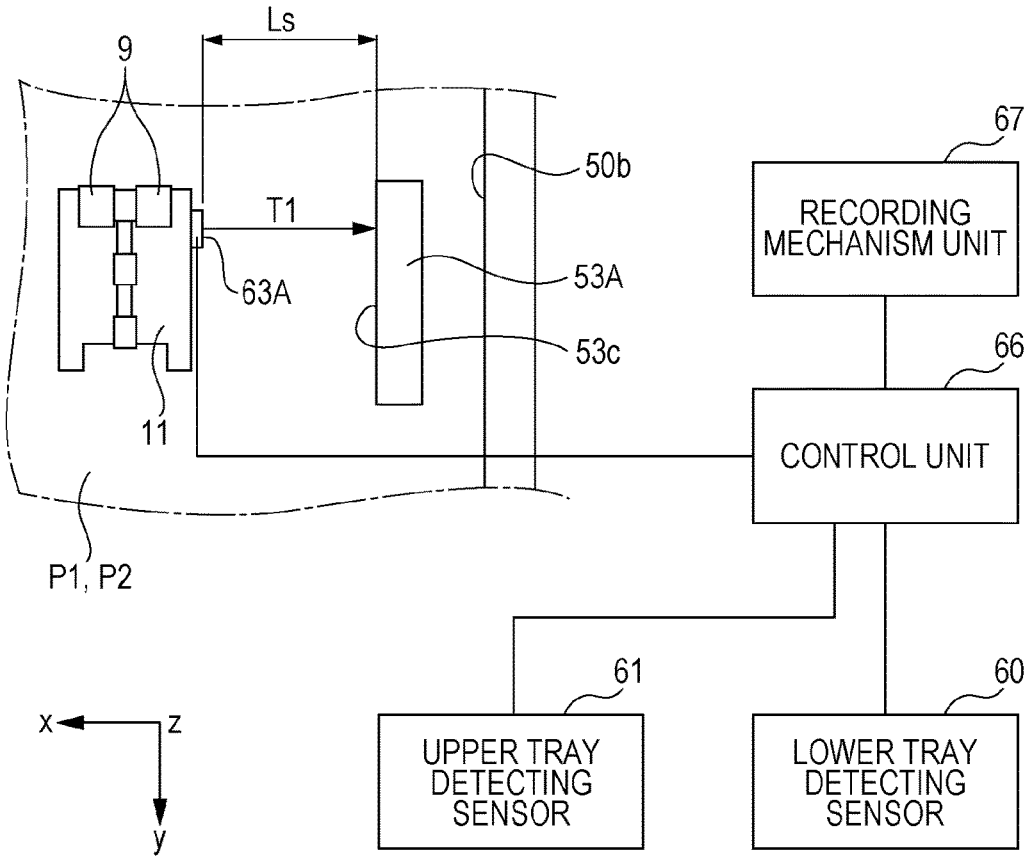
FIG. 8 is a block diagram showing portions of a control system of the printer according to the invention.
Figure 9:
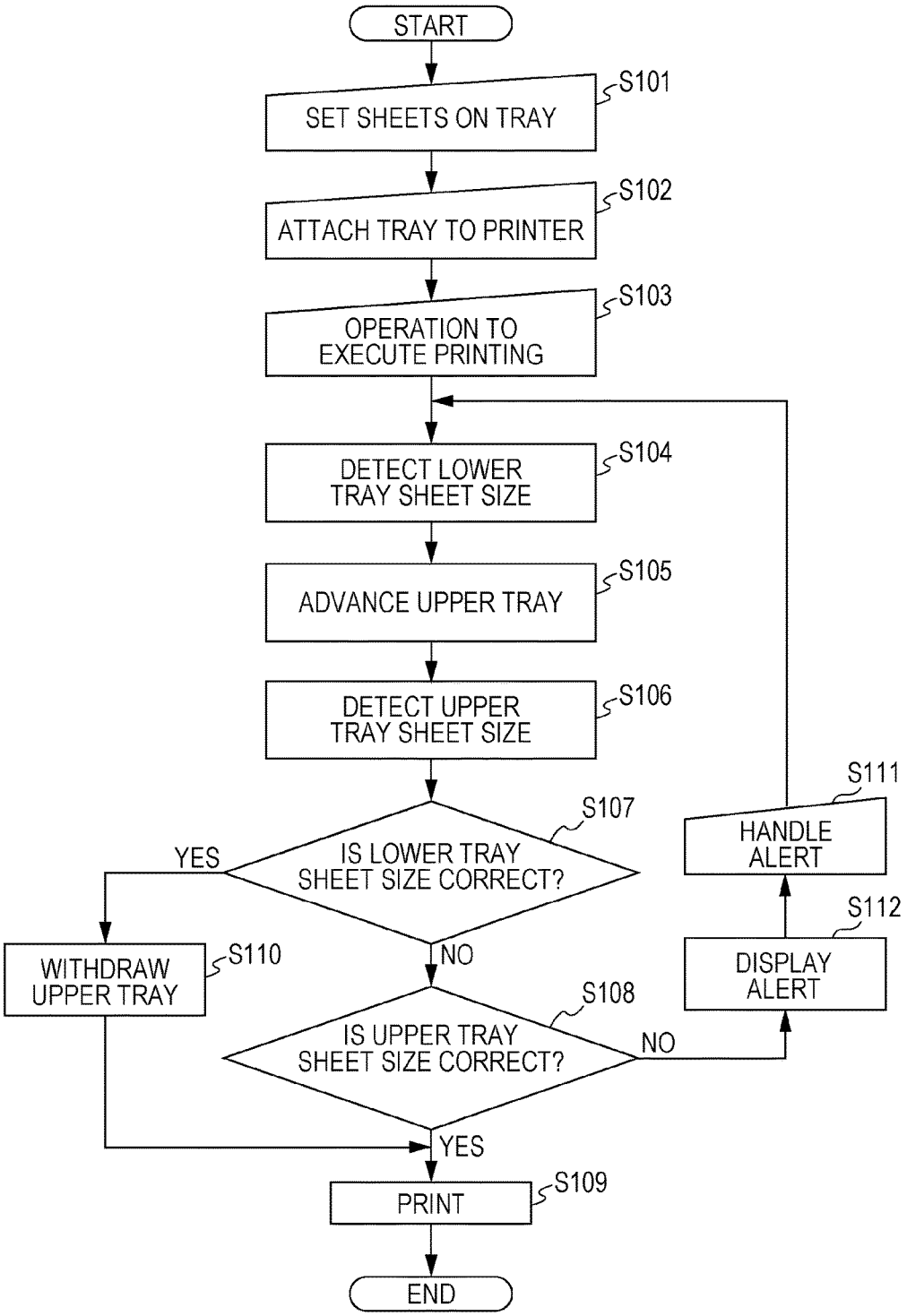
FIG. 9 is a flowchart showing an example of processing performed at the time of printing.
Figure 10:
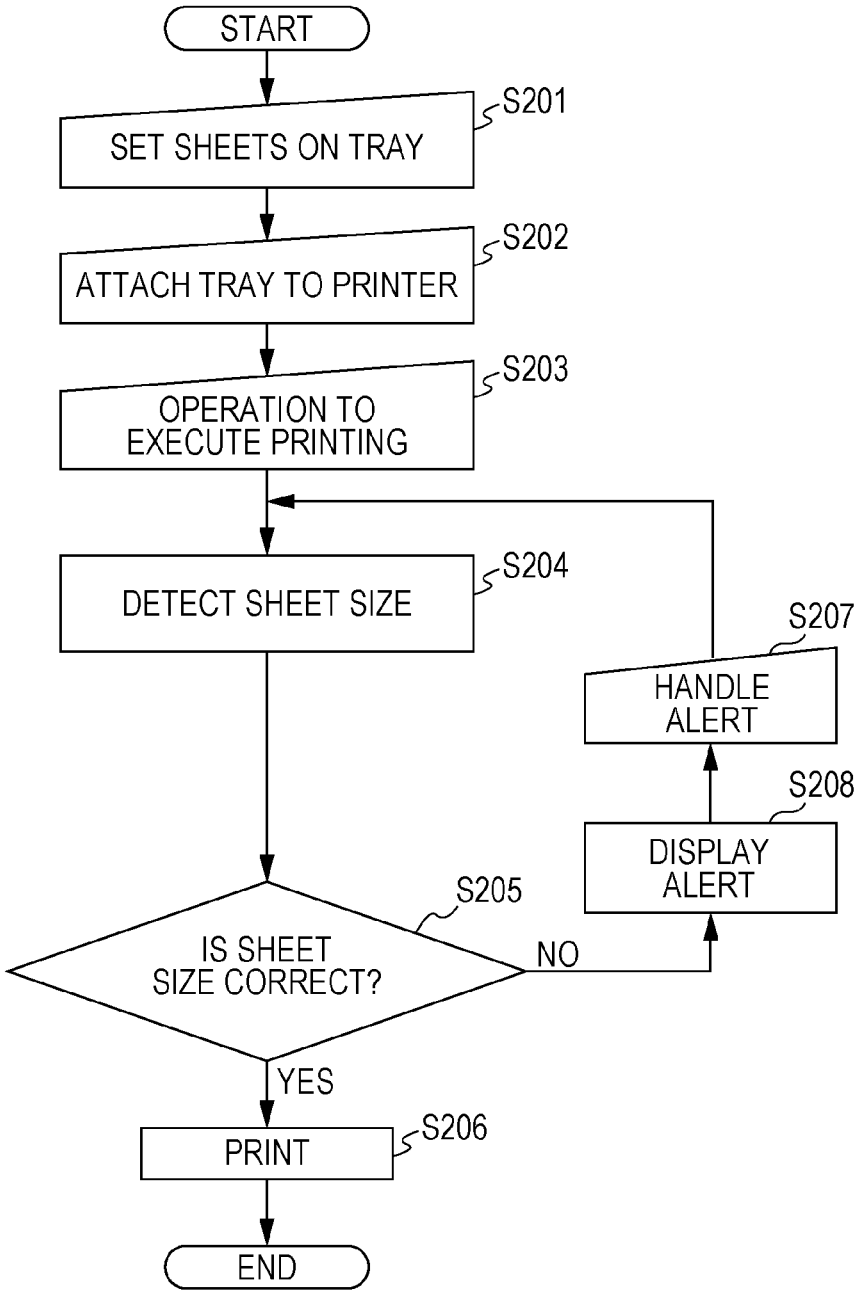
FIG. 10 is a flowchart showing another example of processing performed at the time of printing.

FIG. 1 is an external perspective view of a printer 1 according to the invention. FIGS. 2 to 4 are side sectional views showing a sheet transport path of the printer 1. Furthermore, FIG. 5 is a perspective view showing a lower tray, a roller support member, and an edge guide sensor. FIG. 6 is a side sectional view showing a state in which the lower tray does not contain any sheet. FIG. 7 is a side sectional view showing a state in which the lower tray houses sheets up to an upper-limit height. FIG. 8 is a block diagram showing portions of a control system of a printer according to the invention. FIGS. 9 and 10 are flowcharts of examples of processing performed at the time of printing.

Figure 11:
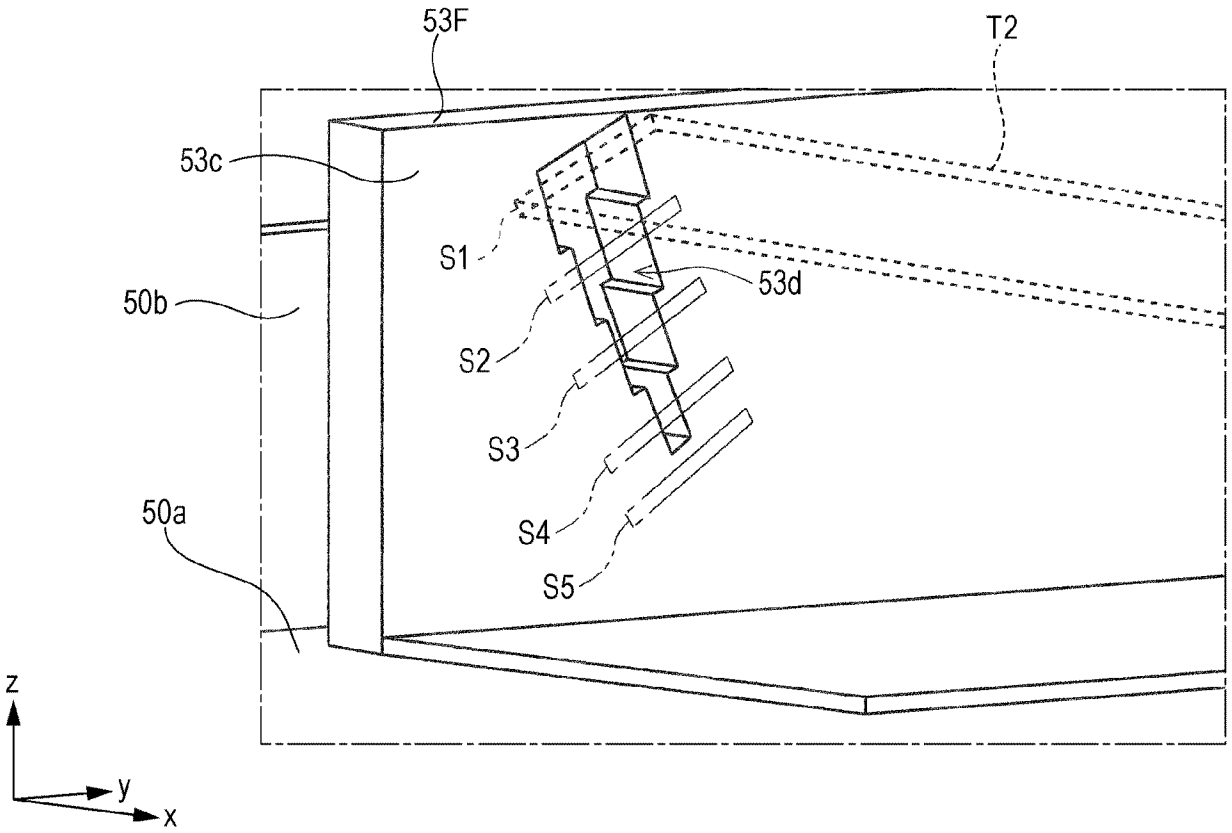
FIG. 11 is a perspective view of a light passing portion that is formed in an edge guide according to another exemplary embodiment of the invention.
Figure 12:
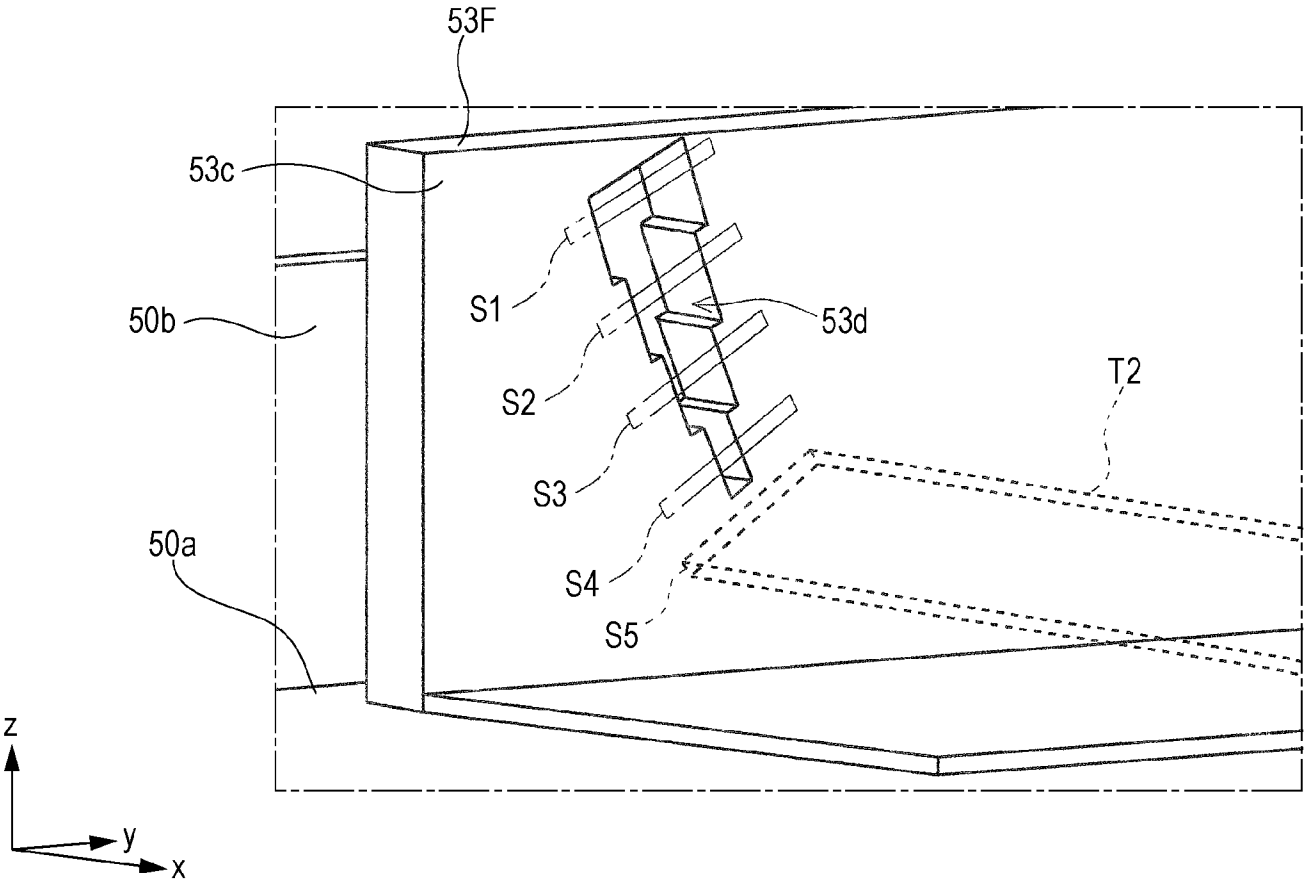
FIG. 12 is a perspective view of the light passing portion formed in the edge guide according to the another exemplary embodiment.
Figure 13:
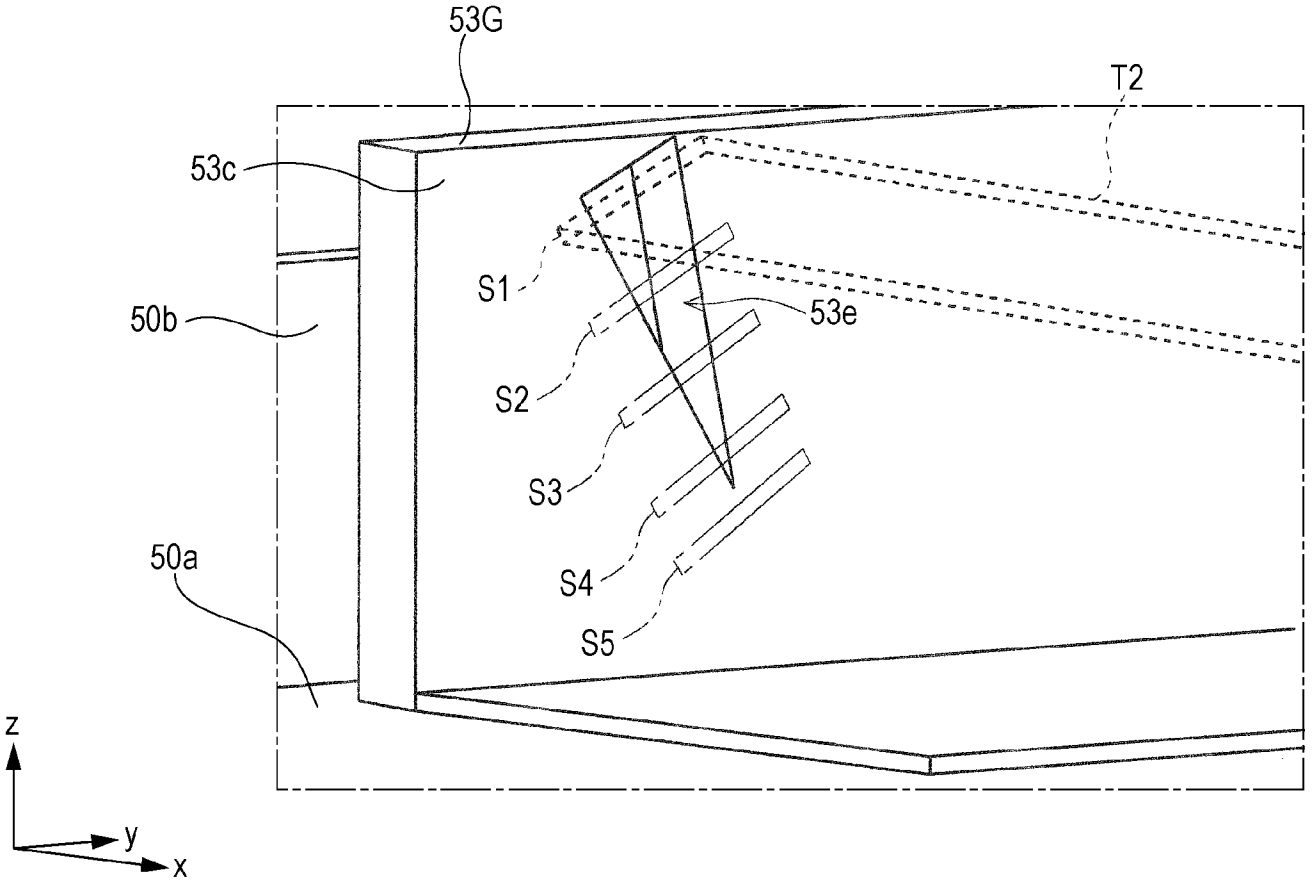
FIG. 13 is a perspective view of a light passing portion formed in an edge guide according to the another exemplary embodiment.
Figure 14:
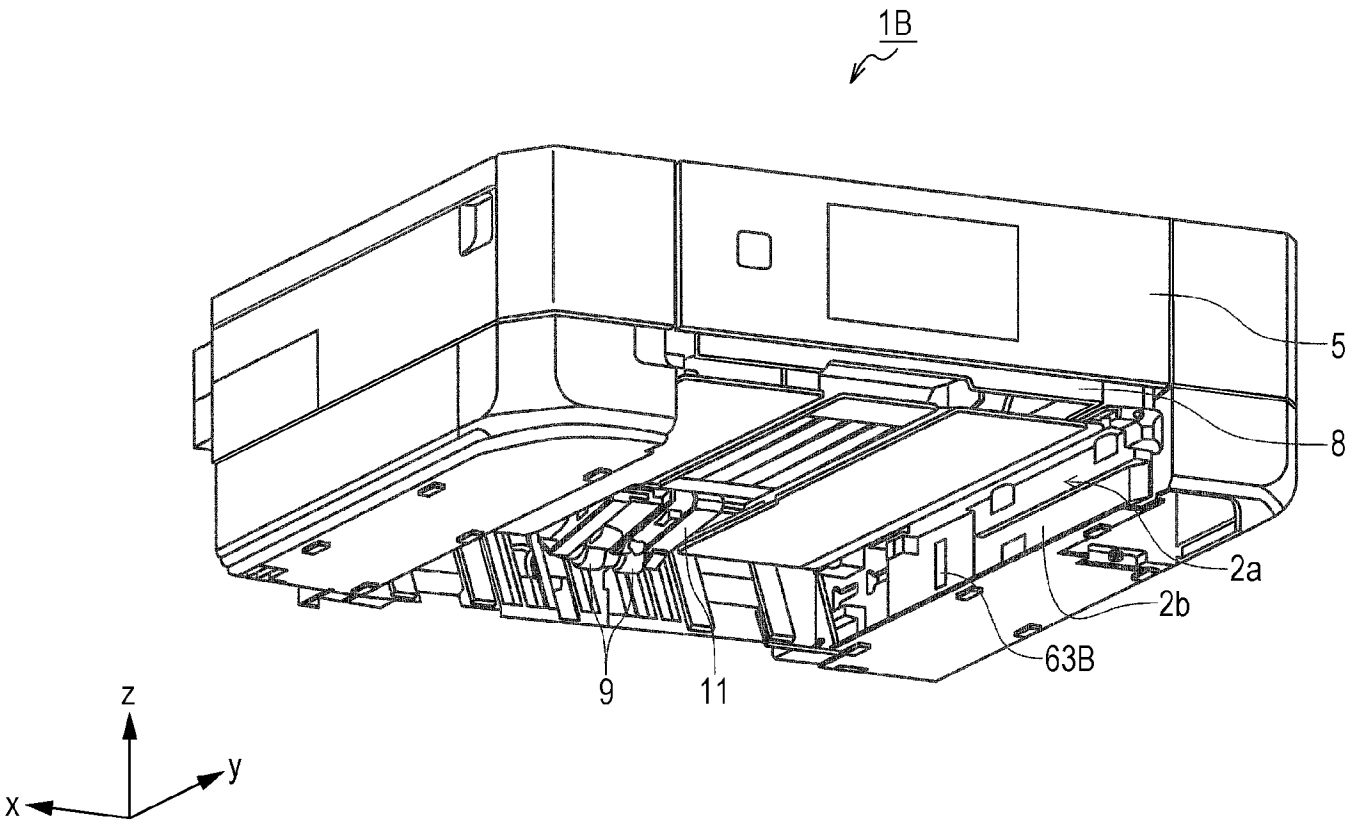
FIG. 14 is a perspective view of a tray housing section of a printer according to still another exemplary embodiment.
Figure 15:
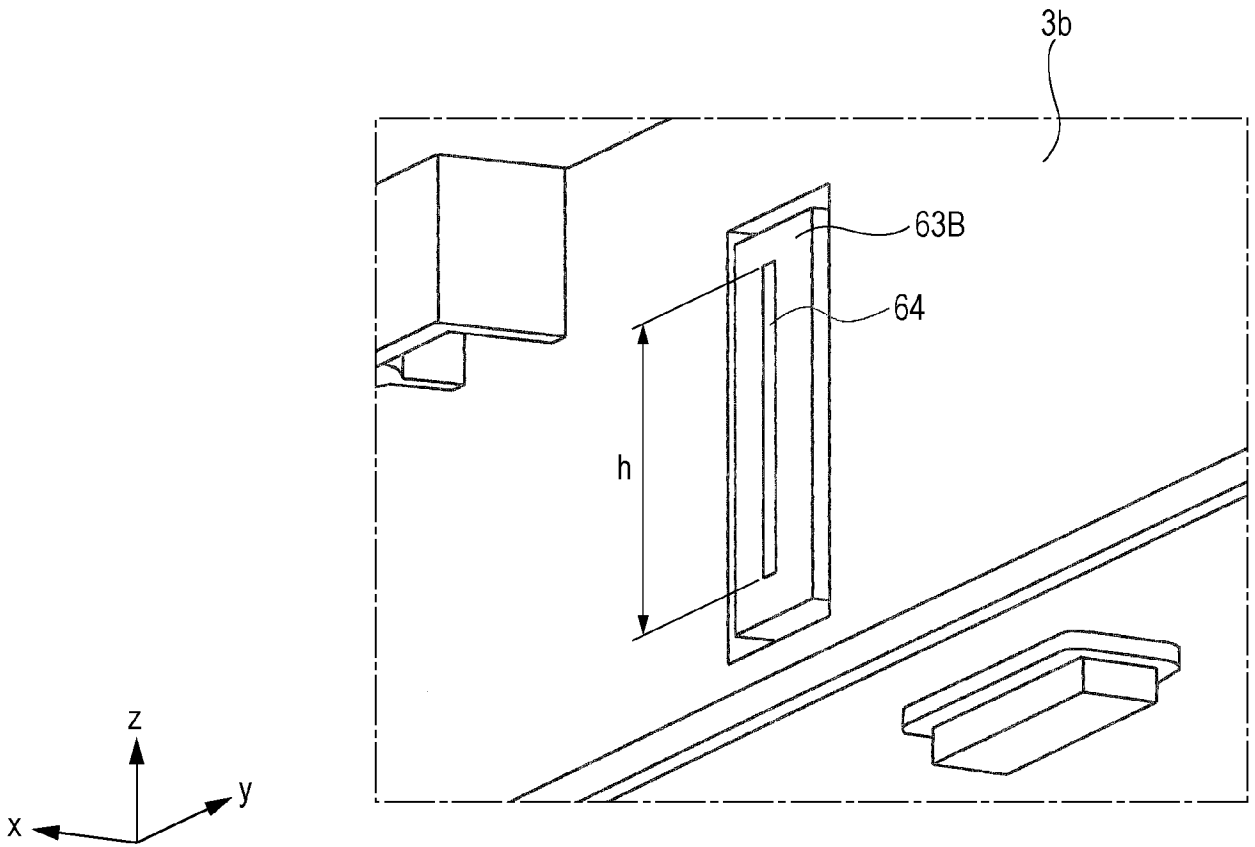
FIG. 15 is an enlarged view of portions shown in FIG. 14.
Figure 16:
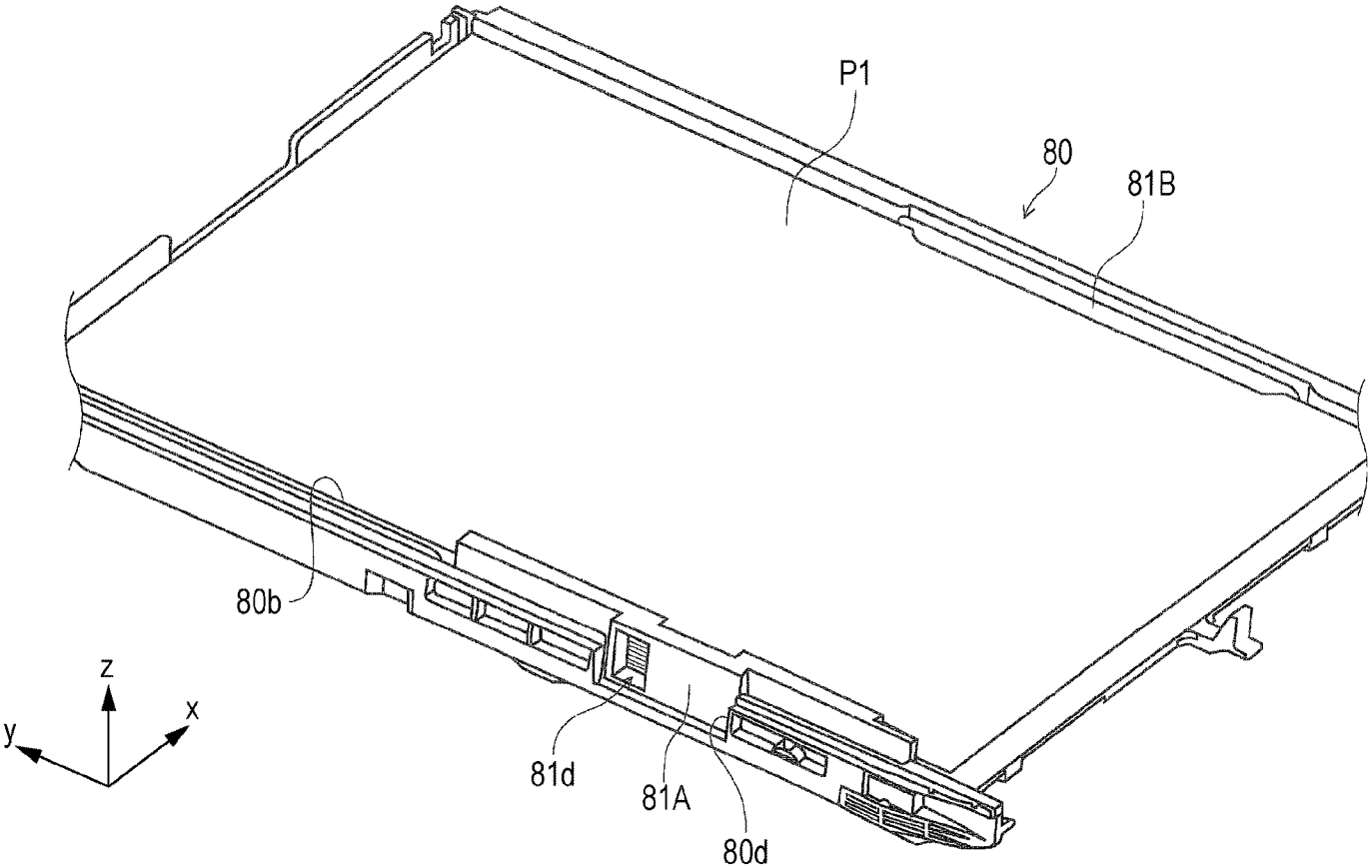
FIG. 16 is a perspective view of a lower tray according to the still another exemplary embodiment.
Figure 17:
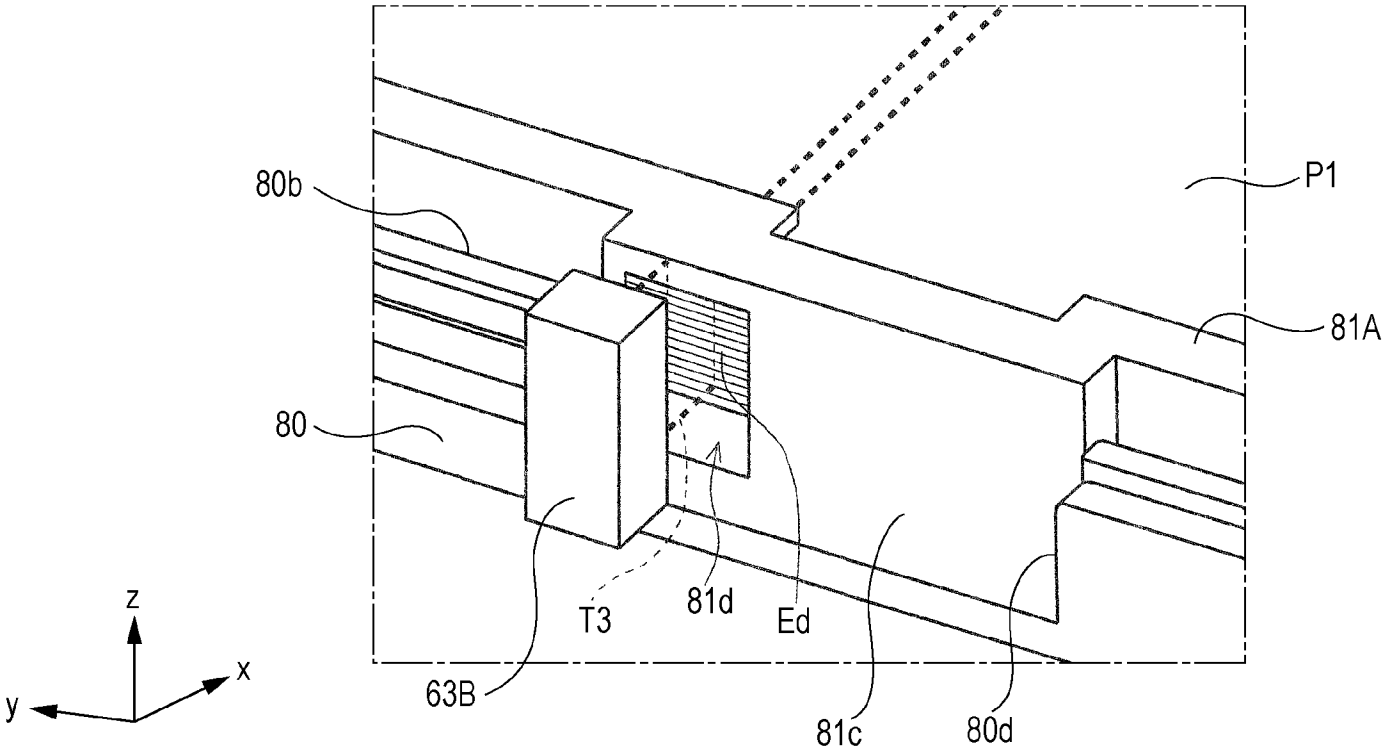
FIG. 17 is a perspective view illustrating a relation between an edge guide sensor and an edge guide.
Figure 18:
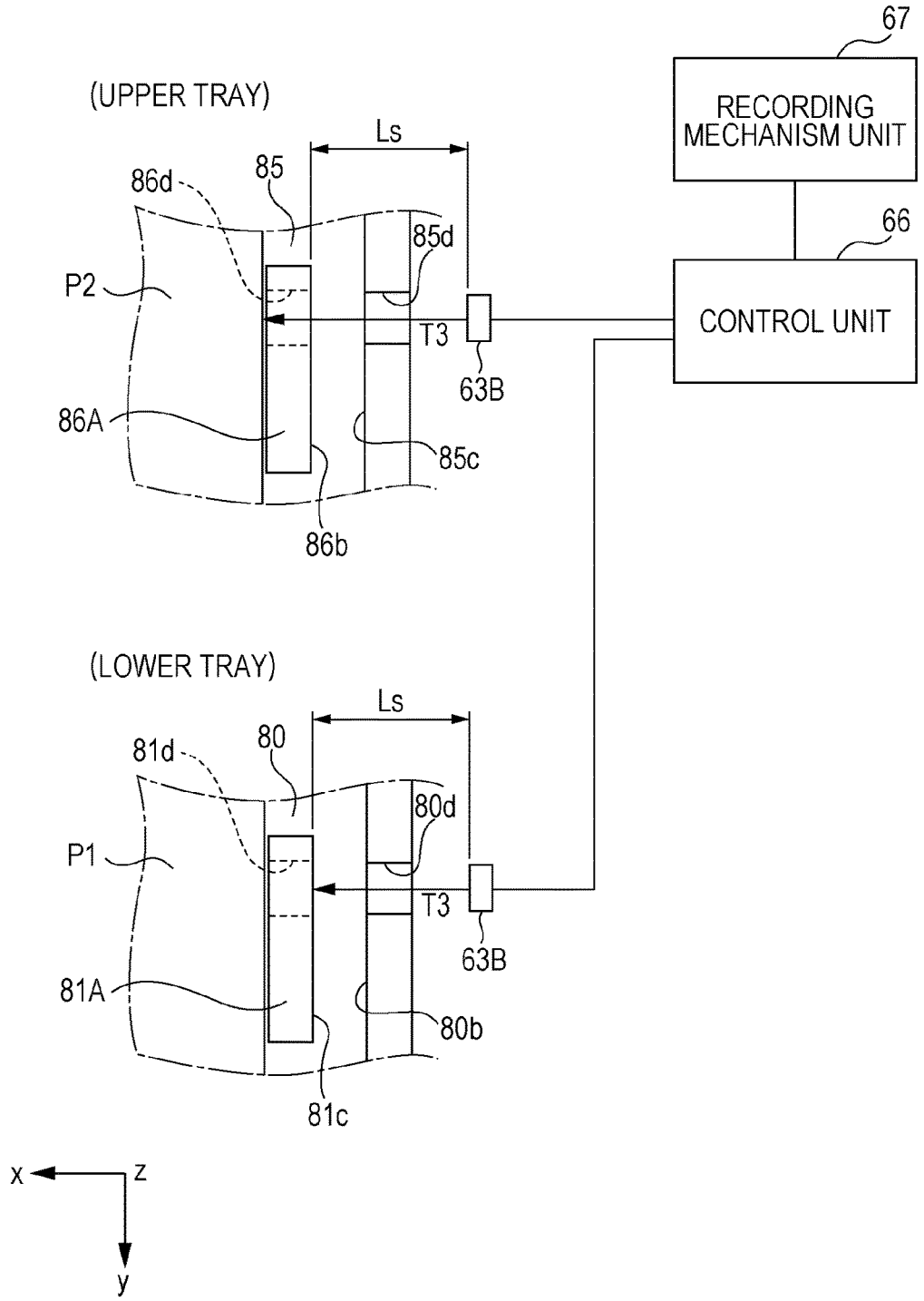
FIG. 18 is a block diagram illustrating portions of a control system of a printer according to the still another exemplary embodiment.
Figure 19A:
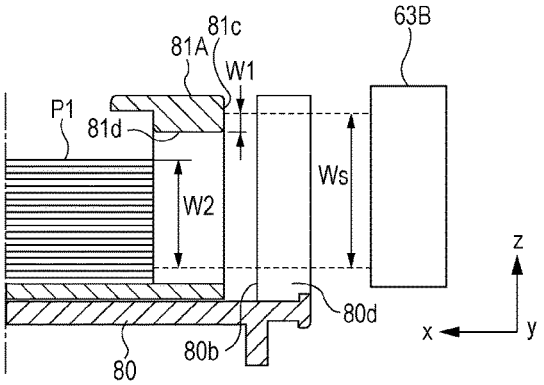
FIGS. 19A to 19B are side sectional views illustrating a relation between the edge guide sensor and the edge guide.
Figure 19B:
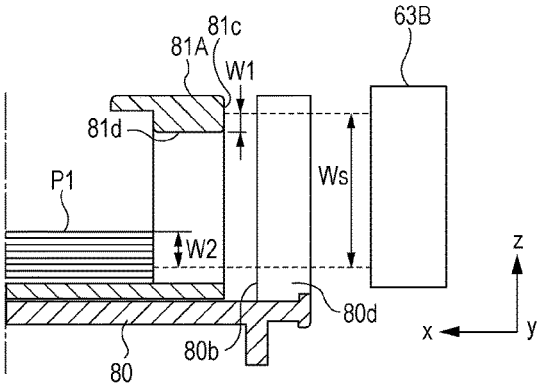
Figure 19C:
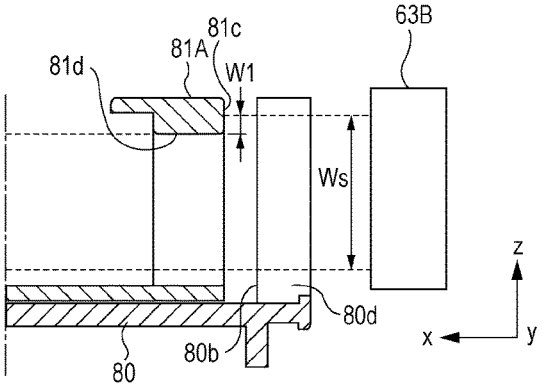
FIG. 19C shows a state in which there is no sheet remaining.

Furthermore, FIGS. 11 to 13 are each a perspective view of a light passing portion that is formed in an edge guide according to another exemplary embodiment. FIG. 14 is a perspective view of a tray housing section of a printer according to still another exemplary embodiment. FIG. 15 is an enlarged view of portions of the printer shown in FIG. 14. FIG. 16 is a perspective view of a lower tray according to still another exemplary embodiment. FIG. 17 is a perspective view showing a relation between an edge guide sensor and an edge guide. FIG. 18 is a block diagram showing portions of a control system of a printer according to still another exemplary embodiment. FIGS. 19A to 19B are side sectional views showing a relation between the edge guide sensor and the edge guide. FIG. 19A shows a state in which sheets are housed up to an upper-limit height. FIG. 19B shows a state in which the quantity of sheets has reduced to or below half the upper-limit height, and FIG. 19C showing a state in which there is no sheet.

Figure 20:
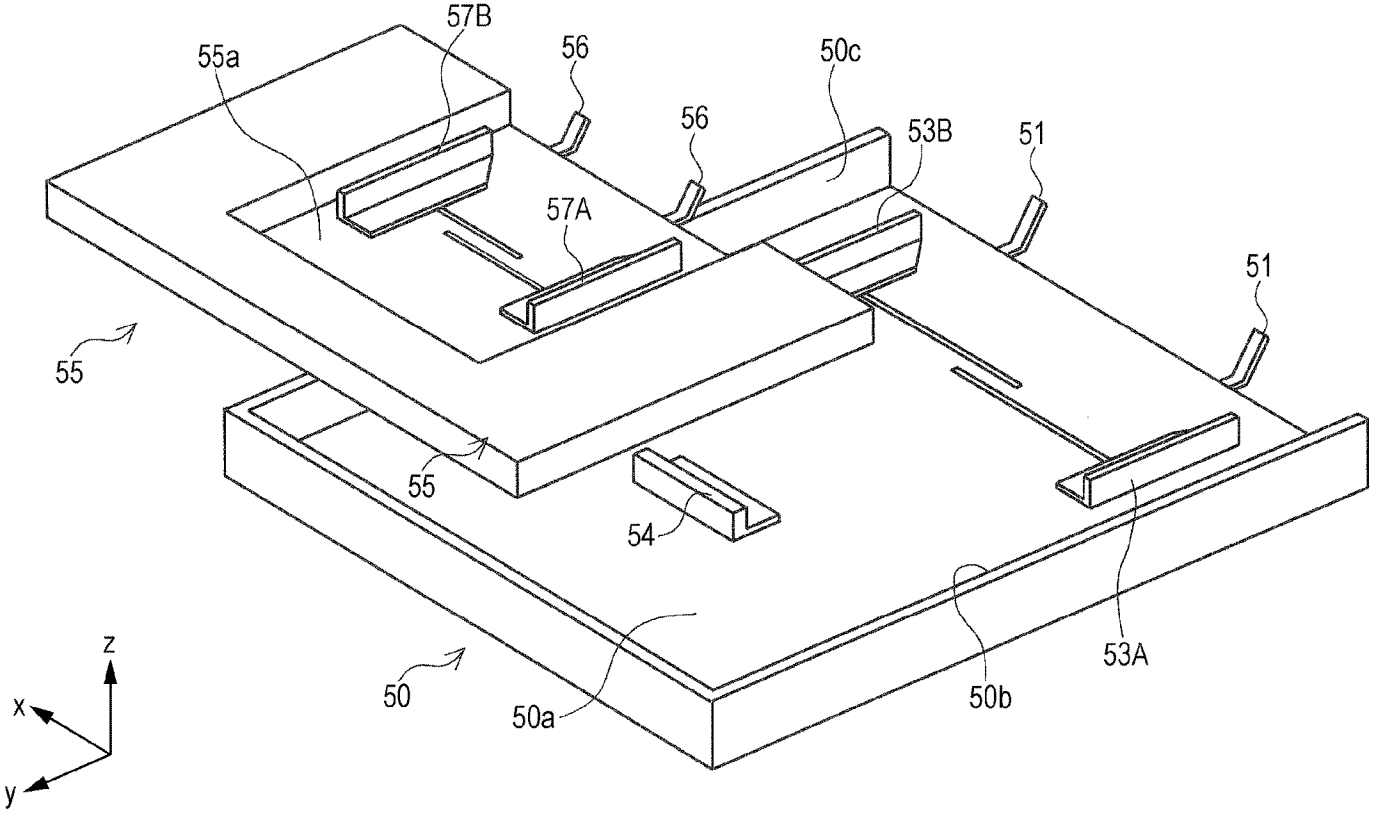
FIG. 20 is a perspective view showing an exemplary embodiment of an upper tray and a lower tray.
Figure 21:
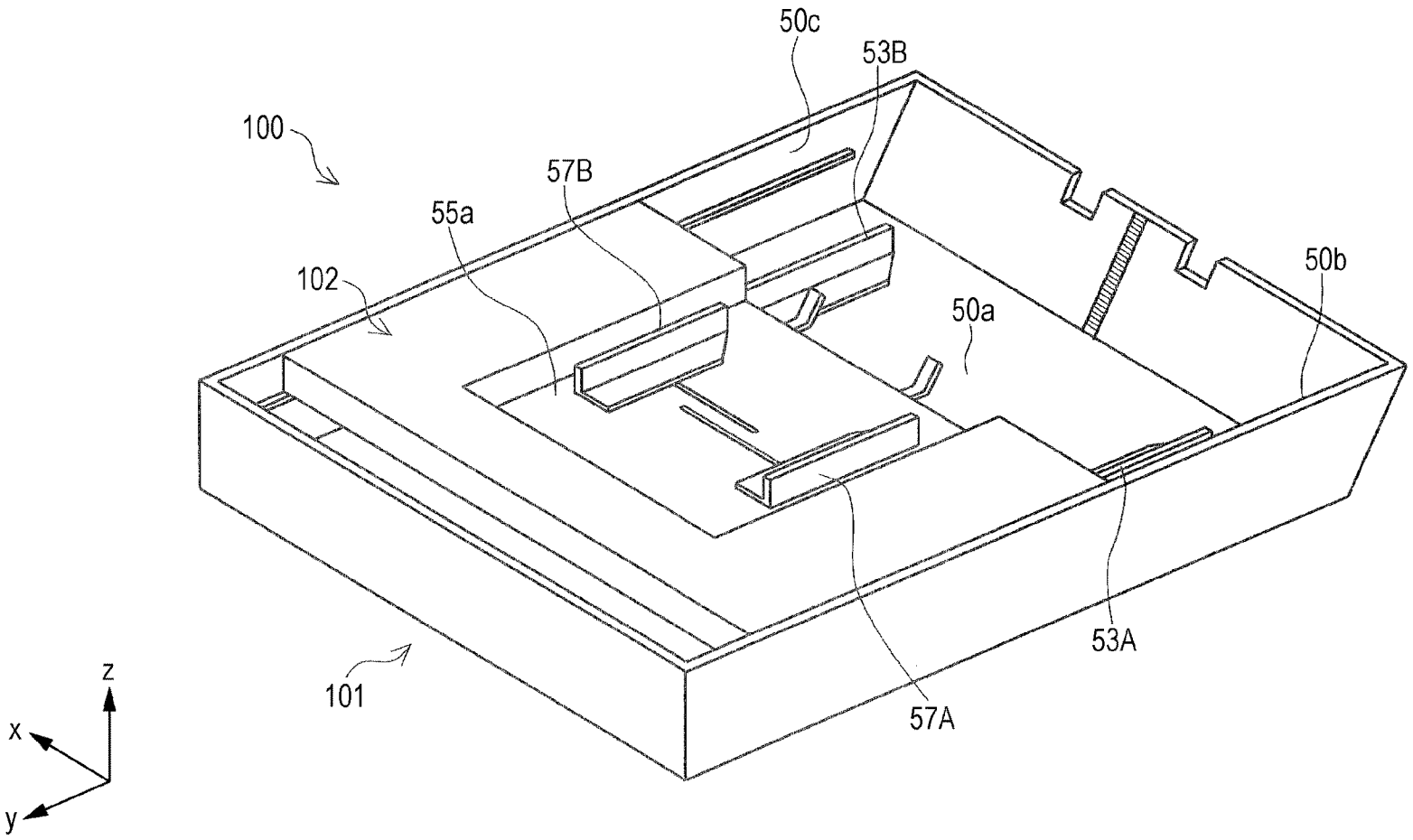
FIG. 21 is a perspective view showing another exemplary embodiment of an upper tray and a lower tray.
Figure 22:
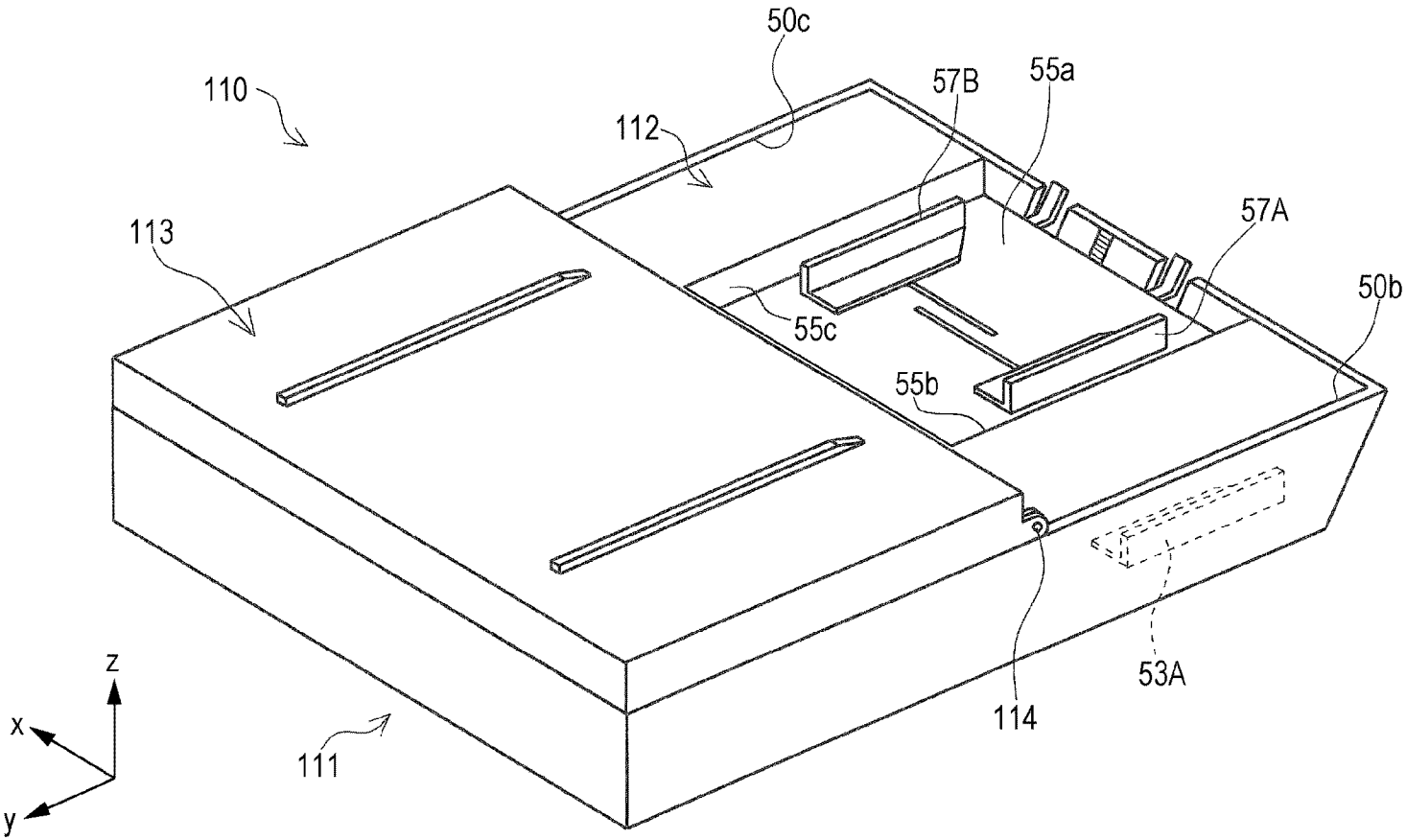
FIG. 22 is a perspective view showing still another exemplary embodiment of an upper tray and a lower tray.
Figure 23B:
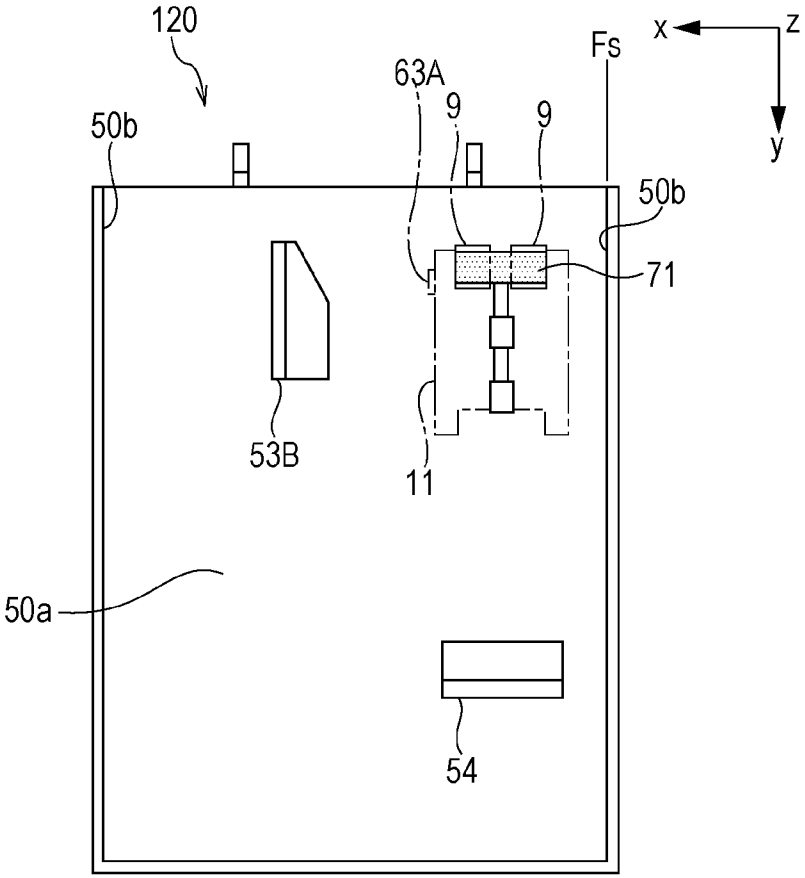
FIG. 23B is a plan view of a tray based on a one-sided-reference feeding method.
Figure 23A:
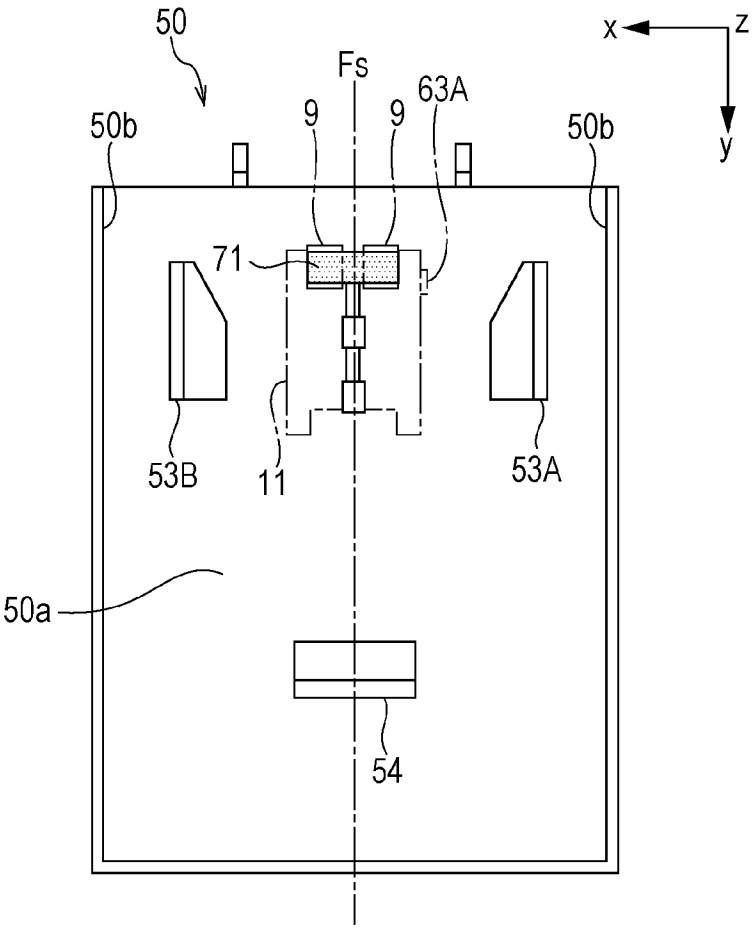
FIG. 23A is a plan view of a tray based on a centered-reference feeding method.
Figure 24:
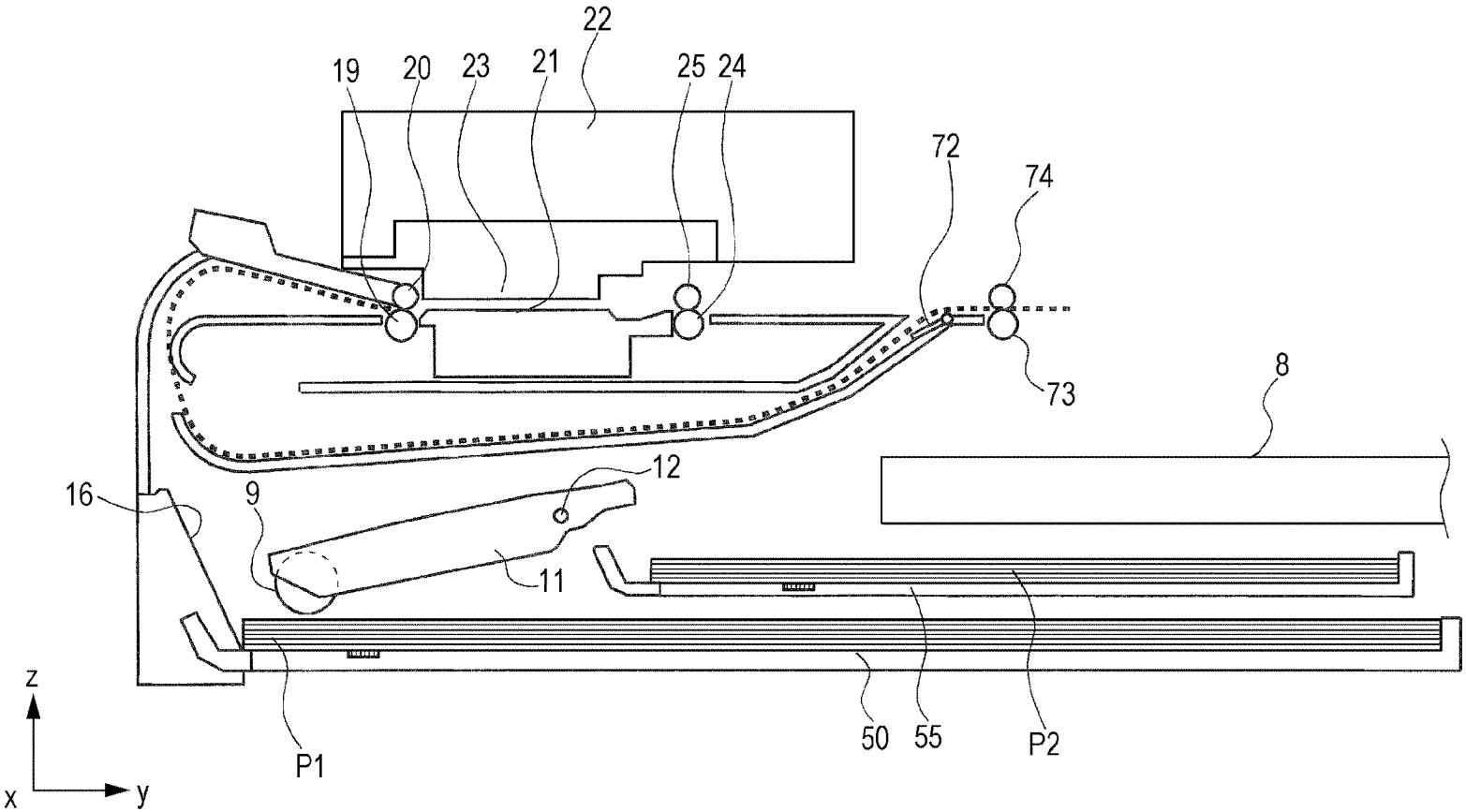
FIG. 24 is a side sectional view illustrating a sheet transport path of a printer according to a further exemplary embodiment.

Further, FIGS. 20 to 22 are perspective views showing exemplary embodiments of an upper tray and a lower tray. FIG. 23A is a plan view of a tray based on a centered-reference feeding method. FIG. 23B is a plan view of a tray based on a one-sided reference feeding method. FIG. 24 is a side sectional view showing a sheet transport path of a printer according to a further exemplary embodiment.

In each drawing, an x-y-z coordinate system is for showing directions, the z direction being a vertical direction (apparatus height direction), the y direction being a sheet feed/transport/discharge direction (apparatus front/rear direction), and the x direction being a sheet width direction (apparatus left-right direction).

Furthermore, in conjunction with the drawings showing different exemplary embodiments, like components and the like are denoted by like reference characters, and redundant descriptions thereof will be omitted as appropriate.

1. Overall Construction of Printer

An overall construction of a printer 1 that is an exemplary embodiment of the recording apparatus of the invention will be briefly described hereinafter with reference to FIGS. 1 to 4. The printer 1 includes a scanner unit 3 in an upper portion of an apparatus body (recording unit) 2 that performs ink jet recording on recording sheets as an example of a medium, that is, the printer 1 is configured as a multifunction machine that has a scanner function in addition to the ink jet recording function.

The scanner unit 3 is provided pivotably relative to the apparatus body 2, and can be pivoted to assume a closed state (FIG. 1) and an open state (not depicted).

An upper cover 4 of the scanner unit 3 is a cover that can be opened and closed. By opening the cover 4, a platen 3*a* (FIGS. 2 to 4) of the scanner unit 3 is exposed.

On an apparatus front surface there is an operation panel (operation unit) 5 that includes, for example, a power button, operation buttons for performing various print settings and executing recording, a display unit that displays contents of print settings, a preview screen of a print image, etc.

Also on the apparatus front surface, an openable and closable cover 52 is provided on a lower tray 50. By opening the cover 52 as shown in FIG. 1, the lower tray 50 and the upper tray 55 that constitute a recording medium housing section and a discharged sheet receiving tray 8 are exposed.

The discharged sheet receiving tray 8 can assume a state (FIG. 1) in which the discharged sheet receiving tray 8 is housed within the apparatus body 2 and a state (FIGS. 2 to 4) in which the discharged sheet receiving tray 8 is projected forward of the apparatus body 2 by a motor (not depicted). By assuming the state of being projected forward of the apparatus body 2, the discharged sheet receiving tray 8 can receive recording sheets that are discharged after being subjected to recording.

The lower tray 50 and the upper tray 55 each capable of housing a plurality of recording sheets are a medium housing section that houses a medium. That is, the medium housing section of the printer 1 is composed of a plurality of sheet trays. The lower tray 50 and the upper tray 55 provided above the lower tray 50 are each independently detachably attachable to the apparatus body 2. Furthermore, if one of the two trays is not attached, recording sheets can still be fed out from the other tray provided that the other tray is attached to the apparatus body 2. Note that the lower tray and the upper tray may also be configured as one integral body instead of separate bodies. An example of such a configuration will later be described.

The upper tray 55 is provided so as to be slidingly displaced by a tray driving unit (not depicted) (which is composed of a driving mechanism that includes a motor) between a withdrawn position (FIG. 3) and an end position (FIG. 2) in a state of being attached to the apparatus body 2. For example, when a print job in which a sheet is fed from the upper tray 55 is executed, a control unit 66 (FIG. 8) of the printer 1 positions the upper tray 55 to the end position shown in FIG. 2. Furthermore, when a print job in which a sheet is fed from the lower tray 50 is executed, the control unit 66 of the printer 1 positions the upper tray 55 to the withdrawn position shown in FIG. 3.

Referring to FIG. 8, the printer 1 includes an edge guide sensor 63A, a lower tray detecting sensor 60, and an upper tray detecting sensor 61. The control unit 66 is capable of recognizing whether the lower tray 50 has been attached, on the basis of signal information sent from the lower tray detecting sensor 60. Furthermore, the control unit 66 is capable of recognizing whether the upper tray 55 is at the end position on the basis of signal information sent from the upper tray detecting sensor 61. Further, the control unit 66 is capable of recognizing the positions of edge guides 53A and 53B provided on the lower tray 50 and the positions of edge guides 57A and 57B provided on the upper tray 55 on the basis of signal information sent from the edge guide sensor 63A. This edge guide sensor 63A will be later described in detail.

The lower tray detecting sensor 60 and the upper tray detecting sensor 61 may be publicly known sensors. Concretely, the lower tray detecting sensor 60 and the upper tray detecting sensor 61 may be contact-type sensors or may also be non-contact type sensors (e.g., optical sensors).

In this exemplary embodiment, since the upper tray 55 is driven by a motor, it is also possible to recognize on which side (which one of the feeding enabled position side and the withdrawn position side) an end position of the upper tray 55 is according to increases in the motor current value on the basis of the motor driving direction.

Referring back to FIG. 1, in a rear upper portion of the apparatus body 2 there is an openable and closable manual feed cover 6. By opening this manual feed cover 6, the manual feeding of recording sheet through the use of a manual feed tray 7 (FIGS. 2 to 4) can be carried out.

Subsequently, a sheet transport path of the printer 1 will be described with reference to FIGS. 2 to 4. The printer 1 according to this exemplary embodiment includes the lower tray 50 and the upper tray 55 described above in a bottom portion of the printer 1. The printer 1 is able to feed recording sheets one at a time from the lower tray 50 or the upper tray 55. The upper tray 55 is slid (displaced) between the end position, that is, the feeding enabled position (FIG. 2), and the withdrawn position (FIG. 3) as described above.

In FIGS. 2 to 4, the sheets housed in the lower tray 50 are denoted by P1, and the sheets housed in the upper tray 55 are denoted by P2 (hereinafter, sheets will be simply referred to as "sheets P" when there is no need to discriminate the sheets). Furthermore, an interrupted line in FIG. 2 indicates a locus of passage of a sheet P2 sent out from the upper tray 55, and an interrupted line in FIG. 3 indicates a locus of passage of a sheet P1 sent out from the lower tray 50.

A feed roller 9 that constitutes a feeder unit and that is rotationally driven by a drive motor (not depicted) is provided on a roller support member 11 as a feed member or a pivoting member that pivots about a pivot shaft 12. When the upper tray 55 is at the withdrawn position (FIG. 3), the feed roller 9 is rotated in contact with the uppermost one of the sheets P1 housed in the lower tray 50 to send out the uppermost sheet P1 from the lower tray 50.

When the upper tray 55 is at the end position (feeding enabled position shown in FIG. 2), the feed roller 9 rotates in contact with the uppermost one of the sheets P2 set on the upper tray 55, so that the uppermost sheet P2 is sent out from the upper tray 55.

Incidentally, whether the tray currently enabled to feed sheets is the lower tray 50 or the upper tray 55 can be detected by the lower tray detecting sensor 60 and the upper tray detecting sensor 61 mentioned above. Instead of these sensors, an encoder that detects the pivot angle of the roller support member 11 may be used. That is, the posture (pivot angle) of the roller support member 11 relative to the sheets differs between when the lower tray 50 feeds sheets P1 and when the upper tray 55 feeds sheets P2. By utilizing such a characteristic, it can be recognized whether the tray currently enabled to feed sheets is the lower tray 50 or the upper tray 55.

As for the construction of such an encoder, for example, a construction in which a rotary scale is provided on the pivot shaft 12 of the roller support member 11 and this rotary scale is read by an optical sensor is conceivable.

Each tray is provided with edge guides that guide the side edges of sheets. The lower tray 50 is provided with edge guides 53A and 53B as shown in FIG. 5. These edge guides 53A and 53B restrict the side edges of sheets. FIG. 5 also shows an edge guide 54 that restricts a rear edge of sheets.

The upper tray 55 is similarly provided with edge guides 57A and 57B as shown in FIG. 20.

In this exemplary embodiment, the feed roller 9 is positioned at a central portion of each tray in the sheet width direction (x direction) that is a direction that intersects the sheet sending-out direction. Thus, sheet feeding is performed based on a centered reference method; therefore, the edge guides of each tray are provided so as to be displaceable together in an interlocked manner in such directions that the two edge guides move closer to and away from each other, with a reference position being at a tray central portion. Concretely, the edge guides 53A and 53B of the lower tray 50 are provided so as to be displaceable together in an interlocked manner in such directions that the edge guides 53A and 53B move closer to and away from each other, with a reference position being at a central portion of the tray in the x direction. Likewise, the edge guides 57A and 57B (FIG. 20) of the upper tray 55 are provided so as to be displaceable together in an interlocked manner in such directions that the edge guides 57A and 57B move closer to and away from each other, with a reference position being at a central portion of the tray in the x direction.

Subsequently, referring back to FIGS. 2 to 4, in the apparatus body 2, a separating slope 16 is provided at a position that faces a distal end of the lower tray 50 and a distal end of the upper tray 55. When the lower tray 50 has been attached, a stopper 51 provided on the distal end of the lower tray 50 reaches a back side (a left side in FIG. 3) of the separating slope 16, so that a distal end of the sheets housed in the lower tray 50 can contact the separating slope 16.

Furthermore, when the upper tray 55 has been positioned at the feeding enabled position, the stopper 56 provided on the distal end of the upper tray 55 reaches the back side of the separating slope 16 and a distal end of the sheets housed in the upper tray 55 can contact the separating slope 16.

Each sheet P sent out from the lower tray 50 or the upper tray 55 moves downstream with its leading end in contact with the separating slope 16, so that the uppermost sheet P, which needs to be fed out, is separated from the subsequent and remaining sheets P.

An intermediate roller 17 that is rotationally driven by a motor (not depicted) is provided downstream of the separating slope 16. Due to the intermediate roller 17, the sheet P is curved and turned around into a direction toward a front side of the apparatus. Reference characters 18A, 18B, 18C and 18D denote driven rollers that are passively rotatable. The sheet P is nipped at least between the driven roller 18A and the intermediate roller 17 or between the driven roller 18B and the intermediate roller 17, and is sent to the downstream side.

Downstream of the intermediate roller 17 there are provided a driving transport roller 19 that is rotationally driven by a motor (not depicted) and a driven transport roller 20 that is passively rotated in contact with the driving transport roller 19. These rollers send the sheet P to under a recording head 23 that constitutes a recording unit.

The recording head 23 that discharges ink is provided in a bottom portion of a carriage 22. The carriage 22 is driven to move back and forth in a main scanning direction (x direction) by a motor (not depicted).

A support member 21 is provided at a position that faces the recording head 23. This support member 21 defines a gap between the sheet P and the recording head 23. At the downstream side of the support member 21 there are a driving discharge roller 24 that is rotationally driven by a motor (not depicted) and a driven discharge roller 25 that is passively rotated in contact with the driving discharge roller 24. The sheet P, after being subjected to recording by the recording head 23, is discharged toward the aforementioned discharged sheet receiving tray 8 by these rollers.

Control subjects that include the driving units (not depicted) that drive the driving transport roller 19, the carriage 22, the recording head 23, the driving discharge roller 24, and the upper tray 55 constitute a recording mechanism unit 67 that is controlled by the control unit 66 shown in FIG. 8.

In FIGS. 2 to 4, a guide member 26 is provided between the intermediate roller 17 and the driving transport roller 19. This guide member 26 forms a sheet transport path between the intermediate roller 17 and the driving transport roller 19. Another guide member 27 forms a sheet transport path between the guide member 26 and the driving transport roller 19. The driven roller 18D, working together with the intermediate roller 17, nips the sheet switched back from the driving transport roller 19 to an upstream side (left side in FIG. 4) at the time of two-sided printing.

That is, as indicated by an interrupted line in FIG. 4, the sheet having been subjected to recording is moved back by the driving transport roller 19 so at to be nipped between the intermediate roller 17 and the driven roller 18D. After that, the sheet, following the substantially the same path as the sheet sent out from the upper tray 55 or the lower tray 50, is transported again to the recording position, in an inverted posture with its recording-subjected surface facing down. Thus, it becomes possible to execute recording on the second surface opposite the first surface that has been subjected to recording.

As for the path for inverting the sheet, it is also possible to adopt, instead of the configuration shown in FIG. 4, a configuration as shown in FIG. 24 in which a sheet is moved under a support member 21 to re-enter the feeding path from each tray. The configuration shown in FIG. 24 further includes a second driving discharge roller 73, a second driven discharge roller 74, and a path switching member 72. When recording is performed on the first surface (obverse surface), the path switching member 72 is in a posture of closing the path that extends under the support member 21.

After a rear end of the sheet passes by the path switching member 72, the second driving discharge roller 73 is reversely driven to move back the sheet. At that time, the path switching member 72 assumes a posture (posture shown in FIG. 24) of opening the path that extends under the support member 21. Due to this, the sheet's rear end enters the lower path. Then, as indicated by an interrupted line in FIG. 24, the sheet whose first surface (obverse surface) has been subjected to recording is inverted, and is sent again to the recording position, with the second surface (reverse surface) facing up.

Thus, the path for inverting a sheet in order to perform recording on the two surfaces of the sheet can be provided in various configurations. In such configurations, the lower tray and the upper tray, which are media housing sections, may be not only the foregoing trays 50, 55, that is, the trays 50, 55 shown in FIG. 20, but also various other types of trays, for example, a tray 100 schematically shown in FIG. 21, a tray 110 schematically shown in FIG. 22, etc.

2. Detection of Sheet Size in Each Tray

Units for detecting the size of sheets in each tray will be described with reference to FIG. 5 and the subsequent drawings.

First Exemplary Embodiment

A construction of a first exemplary embodiment will be described through the use of the edge guide 53A provided on the lower tray 50 as appropriate. Substantially the same description applies to the edge guide 57A that is provided on the upper tray 55.

An edge guide sensor 63A is provided at a position that is below the roller support member 11 and that faces the edge guide 53A, which is one of the pair of edge guides. In other words, the edge guide sensor 63A is spaced from the edge guide 53A by a gap in the displacement direction (x direction) of the edge guide 53A.

The edge guide sensor 63A is a detection unit that detects the position of the edge guide 53A in the lower tray 50 and, more concretely, the distance (distance in the x direction) between the edge guide sensor 63A and the edge guide 53A. Furthermore, the edge guide sensor 63A is also a detection unit that detects the distance (distance in the x direction) between the edge guide sensor 63A and the edge guide 57A (of the upper tray 55).

The edge guide sensor 63A is an optical sensor that includes a light emitting portion and a light receiving portion in this exemplary embodiment, and emits detection light to a guide surface (surface that guides a sheet edge) of each edge guide and receives light reflected from the guide surfaces. For example, in FIGS. 5 and 8, a guide surface 53*c* guides an edge of sheets P1. The edge guide sensor 63A emits detection light to the guide surface 53*c*, receives light reflected from the guide surface 53*c*, and then calculates a distance Ls (FIG. 8) to the guide surface 53*c* by evaluating and computing the reflected light received. The calculated distance Ls is output to the control unit 66. That is, the edge guide sensor 63A also functions as a computation unit that calculates the distance Ls to the guide surface 53*c* by evaluating and computing the reflected light from the guide surface 53*c*.

The edge guide sensor 63A is a known distance sensor and can employ various measurement methods. For example, a triangulation range finding method in which a distance Ls is converted from the imaging position in a light receiving element which changes with changes in the distance to a measurement object, a measurement method in which the time taken for floodlight from a light emitting portion to be received by a light receiving portion after being reflected by a measurement object is measured and converted into a distance Ls, etc. can be employed. Furthermore, the edge guide sensor 63A is not limited to optical sensors but may be an ultrasonic sensor or other detection units of different methods.

In FIG. 8, detection light T1 emitted from the edge guide sensor 63A toward the guide surface 53*c* is schematically indicated.

Although FIG. 8 shows an example in which the edge guide sensor 63A faces the edge guide 53A that is provided on the lower tray 50, a similar arrangement can be applied to a case where the edge guide sensor 63A faces the edge guide 57A that is provided on the upper tray 55.

As described above, due to the edge guide sensor 63A, the positions of the edge guides 53A and 57A can be recognized, that is, the size of the sheets housed in each tray can be recognized.

Note that the edge guide sensor 63A is provided at such a position as to be able to face the guide surface of each edge guide of either one of the trays when sheets are housed in the tray up to an upper-limit height in terms of the housing capacity of the tray. FIGS. 6 and 7 show this. That is, FIG. 6 shows a positional relation between the edge guide sensor 63A (detection light T1) and the edge guide 53A when no sheet is housed, and FIG. 7 shows a positional relation between the edge guide sensor 63A (detection light T1) and the edge guide 53A when sheets are housed up to the upper-limit height (up to the maximum number of sheets that can be housed).

As shown in FIG. 7, the edge guide sensor 63A (detection light T1) is provided at such a position as to be able to face the guide surface of the edge guide 53A when the tray concerned (the lower tray 50 in the example shown in FIG. 7) houses sheets up to the upper-limit height in terms of the housing capacity, so that the edge guide sensor 63A can recognize the position of the edge guides of each tray regardless of the quantity of sheets housed in the tray.

As described above, the control unit 66 of the printer 1 can recognize the size of the sheets housed in each tray by using the edge guide sensor 63A, and therefore can perform necessary processings on the basis of the recognized size of the sheets.

FIG. 9 shows an example of such a processing in which steps S101 to S103 and step S111 are performed by a user and the other processes are performed by the printer.

A user sets sheets on the lower tray 50 or the upper tray 55 (step S101), attaches the tray to the printer 1 (step S102), and performs an operation for execution of the printing (step S103). Then, the control unit 66 of the printer 1 detects the size of the sheets on the lower tray 50 by using the edge guide sensor 63A (step S104). Incidentally, it is assumed that at this time, the upper tray 55 is at the withdrawn position (FIG. 3).

Next, the upper tray 55 is moved to the advanced position (end position) (FIG. 2) (step S105), and detects the sheet size of the upper tray 55 (step S106).

Next, based on the sheet size information included in the print setting information, the control unit 66 determines whether the size of the sheets set on the lower tray 50 is correct (step S107). If the sheet size of the lower tray 50 is correct (Yes in step S107), the control unit 66 moves the upper tray 55 to the withdrawn position (FIG. 3) (step S110), and then performs the sheet feeding from the lower tray 50 to perform the printing (step S109).

On the other hand, if the size of the sheets set in the lower tray 50 is not correct (No in step S107), it is then determined whether the size of the sheets housed in the upper tray 55 is correct (step S108). If the sheet size of the upper tray 55 is correct (Yes in step S108), the sheet feeding is performed from the upper tray 55 to perform the printing (step S109).

If the size of the sheets housed in the upper tray 55 is not correct either (No in step S108), the control unit 66 causes a display unit provided for the operation unit 5 (FIG. 1) of the printer 1, an external computer (not depicted) connected to the printer 1, or some other apparatus capable of transmitting information to carry out alert display (step S112).

This alert display may be, for example, a display stating that "A sheet of the designated size may not be set. Please check the sheets.", or the like.

In response to this alert display, the user performs a series of alert handling operations, such as checking the sheets, performing re-setting, and cancelling the alert display (step S111). After that, the control unit 66 executes the processes of step S104 and the subsequent steps.

As for the case where the sheet size included in the print setting information and the size of the sheets housed in the lower tray 50 or the upper tray 55 do not match, conceivable cases include not only the case where the size of the sheets housed in the lower tray 50 or the upper tray 55 is actually not correct against the sheet size that is included in the print setting information but also the case where although the size of the sheets actually housed is equal to the sheet size included in the print setting information, the user has made an error in performing (forgotten to perform) the setting of the edge guide 53A or 57A. The alert handing operation in step S111 in this case includes the user's moving the edge guides to appropriate positions.

The example of the processing described above is based on the configuration in which the upper tray 55 is moved between the advanced position (FIG. 2) and the withdrawn position (FIG. 3) by a drive source such as a motor or the like. It is also possible to adopt a configuration in which the upper tray 55 is displaced manually instead of automatically.

FIG. 10 is a flowchart showing an example of a processing performed in such a configuration. In the flowchart, steps S201 to S203 and S207 are performed by the user and the other processes are performed by the printer 1.

The user sets sheets on the lower tray 50 or the upper tray 55 (step S201), attaches the tray to the printer 1 (step S202), and performs an operation for execution of the printing (step S203). Then, the control unit 66 of the printer 1 detects the sheet size by using the edge guide sensor 63A (step S204). The sheet size detection at this time is performed with respect to the lower tray 50 if the upper tray 55 is at the withdrawn position (FIG. 3), and is performed with respect to the upper tray 55 if the upper tray 55 is at the advanced position (FIG. 2).

Subsequently, based on the sheet size information included in the print setting information, the control unit 66 determines whether the detected sheet size is correct against the sheet size included in the print setting information (step S205). If the detected sheet size is correct (Yes in step S205), the sheet feeding is performed to perform the printing (step S206).

Note that the sheet size herein includes not only standardized sizes whose actual sizes are known beforehand but also sizes that users define (user-defined sizes). As for user-define sizes, the longitudinal length and the lateral length of a sheet can be registered under the item of "user-defined size" in a print setting screen (not depicted) that is provided by the printer driver.

This registered size is used as a sheet size for the determination of correctness or incorrectness about the sheet size in step S205.

On the other hand, if the actual sheet size is not correct (No in step S205), the control unit 66 causes a display unit provided for the operation unit 5 (FIG. 1) of the printer 1, an external computer (not depicted) connected to the printer, or some other apparatus capable of transmitting information to display an alert (step S208). This alert display is substantially the same as the alert display performed in step S112 in FIG. 9.

In response to this alert display, the user performs a series of alert-handling operations, such as checking the sheets, performing re-setting, or cancelling the alert display (step S207). After that, the control unit 66 executes the processes of step S204 and the subsequent steps again.

As described above, the printer 1 includes the edge guides 53A and 57A that are provided on the lower tray 50 and the upper tray 55, respectively, and that can be displaced according to the size of sheets to guide edges of the sheets, and the edge guide sensor 63A that is spaced from the edge guides in the displacement directions of the edge guides and that is capable of detecting the distance to each edge guide.

Therefore, based on the detected distance, the positions of the edge guides in each tray can be recognized. As a result, it is possible to detect not only predetermined sheet sizes but also various other sheet sizes, so that a more appropriate control of sheet feeding can be performed.

Furthermore, since the edge guide sensor 63A is a non-contact type optical sensor, breakage of the sensor related to the detachment and attachment of the trays can be restrained.

Furthermore, in the foregoing exemplar embodiment, the edge guide sensor 63A is provided on a pivot member that pivots, that is, the roller support member 11 that moves closer to and away from the bottom surface of each tray. That is, since the edge guide sensor 63A is provided not on the trays that are detachably attachable but on the apparatus body 2 of the printer 1, the electrical wiring between the edge guide sensor 63A and the control unit 66 can be easily made.

Therefore, in this light, the edge guide sensor 63A does not necessarily need to be provided on the roller support member 11 but may instead be provided on another portion of the apparatus body 2 as well. Such an exemplary embodiment will be described later.

Furthermore, in this exemplary embodiment, the lower tray 50 and the upper tray 55, that is, a plurality of medium housing sections, are provided, and the edge guides 53A and 57A provided on the plurality of medium housing sections are detected by one optical sensor, that is, the edge guide sensor 63A. Therefore, the cost of the apparatus can be reduced.

Although the exemplary embodiment includes the lower tray detecting sensor 60 and the upper tray detecting sensor 61 as described above with reference to FIG. 8, this may be substituted by a construction in which the reflection rates of the detection light T1 emitted to the edge guides 53A and 57A with respect to the edge guides vary from one edge guide to the other, so that which one of the edge guides has been detected, that is, whether the detected edge guide is the one on the lower tray 50 or the one on the upper tray 55, can be recognized on the basis of the different reflection intensities.

Furthermore, the control unit 66 may also be configured to output a predetermined alert when the edge guide sensor 63A does not detect an edge guide. That is, when the edge guide sensor 63A does not detect an edge guide, it is conceivable, for example, that the lower tray 50 or the upper tray 55 has not been set. In that case, an alert, for example, a message that "please check the tray" or the like, can be displayed. Due to this, by prompting the user to check the state of the trays, an appropriate sheet feeding operation can be smoothly performed.

Furthermore, the control unit 66 can also be configured to output a predetermined alert when the distance between the edge guide sensor 63A and any one of the edge guide sensors exceeds a predetermined range. That is, in the case where the distance between the edge guide sensor 63A and any one of the edge guides exceeds a predetermined distance, it is conceivable, for example, that an edge guide is outside the sheet guide range due to the user forgetting to set the edge guides or that a tray houses sheets whose size is not expected for use in the printer 1. In such cases, an alert, for example, a message that "please check the edge guides in the tray" or the like, can be displayed. Due to this, by prompting the user to check the state of the edge guides, an appropriate sheet feeding operation can be smoothly performed.

Second Exemplary Embodiment

By utilizing a sensor that emits a wide beam of detection light as an edge guide sensor, the remaining quantity of sheets can be recognized, in addition to the positions of the edge guides. An exemplary embodiment of such an arrangement will be described hereinafter with reference to FIGS. 11 to 13.

An edge guide 53F shown in FIG. 11 is a modification of the foregoing edge guide 53A. The edge guide 53F is provided with a slit 53*d* as a light passing portion that allows the detection light from an optical sensor to pass through. The slit 53*d* has been formed so that the rate of passage of the detection light from the optical sensor through the slit 53*d* changes along a medium stacking direction (z direction).

More specifically, detection light T2 shown in FIG. 11 is of a wider beam than the foregoing detection light T1. When sheets are housed up to the upper-limit height (maximum number of sheets), the detection light T2 emitted to a guide surface 53*c* of the edge guide 53F irradiates an irradiated region S1. As the number of sheets housed decreases, the irradiated region changes from S1 to S2, S3, S4 and S5. This is because as the number of sheets decreases, the position of contact between the uppermost sheet of the sheets housed in the tray and the feed roller 9 shifts downward and correspondingly the roller support member 11 pivots downward. Since the roller support member 11 pivots, the slit 53*d* is formed in a slightly inclined posture relative to the z direction so as to substantially conform to the pivoting locus of the roller support member 11.

FIG. 11 indicates a state of the detection light T2 when sheets are housed up to the upper-limit height (maximum number of sheets). FIG. 12 indicates a state of the detection light T2 when there are no sheets remaining.

The slit 53*d* is formed so as to stepwise reduce in width as the number of sheets housed decreases. Therefore, as the irradiated region shifts from S1 toward S5, the intensity of reflection of the detection light T2 increases, whereby the control unit 66 can recognize indications of the quantity of remaining sheets in addition to the position of the edge guide 53F.

Incidentally, although the slit 53*d* is formed so that the width thereof stepwise reduces with decreases in the number of sheets housed, it is also permissible to form the slit as indicated by a slit 53*e* shown in FIG. 13 so that the width of the slit continuously reduces with decreases in the number of sheets.

Third Exemplary Embodiment

With reference to FIGS. 14 to 19, an exemplary embodiment in which an edge guide sensor is provided at a location other than the roller support member 11 will be described.

In a printer 1B shown in FIG. 14, an edge guide sensor 63B is provided on an inner wall (a sidewall) 2*b* of a housing section 2*a* that houses an upper tray and a lower tray.

As shown in FIG. 15, the edge guide sensor 63B includes a detection portion 64 widened in an apparatus height direction (z direction), that is, the sheet stacking direction, as shown in FIG. 15, so that a beam of detection light that is widened in the sheet stacking direction is emitted. In FIG. 15, reference character h denotes the height of the detection light.

On the other hand, as shown in FIG. 16, a lower tray 80 according to this exemplary embodiment includes an edge guide 81A that corresponds to the edge guide 53A in the first exemplary embodiment and an edge guide 81B that corresponds to the edge guide 53B. The lower tray 80 is different from the lower tray 50 according to the first exemplary embodiment in that as shown in FIG. 17, too, a tray sidewall 80*b* is provided with a cutout portion 80*d* and the edge guide 81A is provided with a window hole 81*d*. As shown in FIG. 18, an upper tray is similarly constructed. That is, the upper tray 85 according to this exemplary embodiment includes an edge guide 86A that corresponds to the edge guide 57A in the first exemplary embodiment. The upper tray 85 is different from the upper tray 55 according to the first exemplary embodiment in that a tray sidewall 85*c* is provided with a cutout portion 85*d* and the edge guide 86A is provided with a window hole 86*d*.

That is, a feature of this exemplary embodiment is that the tray sidewalls 80*b* and 85*c* are provided with the cutout portions 80*d* and 85*d* as light passing portions that allow detection light T3 from the edge guide sensor 63B provided as a detection unit to pass through, and that the edge guide sensor 63B detects the distance Ls to the edge guide 81A or 86A in the tray via the cutout portion 80*d* or 85*d*. Incidentally, the distance Ls, in the case of the edge guide 81A, is the distance between the edge guide sensor 63B and a wall surface 81*c* of the edge guide 81A opposite to a surface that restricts an edge of sheets and, in the case of the edge guide 86A, is the distance between the edge guide sensor 63B and a wall surface 86*b* of the edge guide 86A opposite to a surface that restricts an edge of sheets.

If the edge guide sensor 63B is provided on the roller support member 11, it is necessary to electrically connect the control unit 66 and the edge guide sensor 63B and provide a cable that is deformable according to the pivoting of the roller support member 11. Furthermore, if the edge guide sensor 63B is provided on a tray as described below, a removably insertable connector needs to be provided so as to connect and disconnect an electrical wiring path between the control unit 66 and the edge guide sensor 63B.

In this exemplary embodiment, since the edge guide sensor 63B is provided on the apparatus body 2 side, the electrical wiring path between the edge guide sensor 63B and the control unit 66 can be easily constructed.

Furthermore, since the light passing portion that allows detection light to pass through is constituted by the cutout portions 80*d* and 85*d* formed in the sidewalls of the trays and the window holes 81*d* and 86*d* formed in the edge guides as described above, it is possible to form the light passing portion in a simple configuration while restraining cost increases.

Still further, in this exemplary embodiment, each edge guide is provided with the window hole 81*d* or 86*d* as a light passing portion that allows passage of the detection light T3 from the edge guide sensor 63B as the detection unit, so that the edge guide sensor 63B can detect the edge of sheets through the window hole 81*d* or 86*d*.

FIGS. 19A to 19C show examples of detection in conjunction with the lower tray 80, in which reference character Ws denotes the width of detection light from the edge guide sensor 63B at the time of detection regarding the lower tray 80. Note that the width h in FIG. 15 is a detection light width for the detection regarding both the lower tray 80 and the upper tray 85 and the width Ws<the width h.

In FIGS. 19A to 19C, reference character W1 denotes an irradiated region when the wall surface 81*c* of the edge guide 81A is irradiated and reference character W2 denotes an irradiated region when the edge of sheets is irradiated. The irradiated region W1 allows the position (distance) of each edge guide to be detected and the irradiated region W2 allows detection of the edge of sheets, that is, whether the quantity of sheets is large or small.

That is, as the number of sheets housed decreases, the irradiated region W2 decreases in size as sequentially shown in FIGS. 19A, 19B and 19C. Thus, the control unit 66 can recognize not only the position of each edge guide, that is, the sheet size, but also the quantity of sheets. That is, both the sheet size and the sheet quantity can be detected using one single detection unit, so that the costs of the apparatus can be lessened.

Although in the exemplary embodiment described above, the edge guide sensor 63B is provided on the inner wall 2*b* (FIG. 14) of the apparatus body 2, a sidewall of each tray may be provided with an edge guide sensor. For example, as for the lower tray 80, an edge guide sensor may be provided directly on the tray sidewall 80*b* (FIG. 16). This allows the edge guide sensor to be disposed at a position near the edge guide, so that high detection accuracy can be achieved in detecting the distance between the edge guide and the edge guide sensor.

Incidentally, in this case, edge guide sensors are provided separately for each tray. Furthermore, when any one of the trays is set, electrical connection of the edge guide sensor to the apparatus body 2 side is secured.

While the examples in which the invention is applied to the upper tray and the lower tray have been described, the invention may also be applied to one single tray instead of a plurality of trays. The meaning of "one single tray" herein includes both one single tray in the case where a recording apparatus has a plurality of trays and one single tray in the case where a recording apparatus has only one tray.

Furthermore, the case where a recording apparatus has a plurality of trays includes not only a case where the trays are provided as separate bodies as described above but also a case where the trays are provided as one single integral body. FIG. 20 shows trays that are provided as separate bodies (as in the foregoing exemplary embodiments). FIG. 21 shows trays that are provided as a single integral body. In FIG. 21, reference character 100 denotes a tray assembly made up of a lower tray 101 and an upper tray 102. The upper tray 102 is provided so as to be slidingly displaceable relative to the lower tray 101. By sliding the upper tray 102, the upper tray 102 can be displaced between a service position and a withdrawn position just as the foregoing upper tray 55 can.

Thus, even in the case where the upper tray and the lower tray are provided as a single integral body, the position of the edge guide of each tray can be detected.

Furthermore, there is also a case where a discharged sheet receiving tray that receives sheets discharged after being subjected to recording is integrated with sheet feeding trays. FIG. 22 shows such trays, with reference character 110 denoting a tray assembly that includes a lower tray 111 and an upper tray 112. The upper tray is provided so as to be slidingly displaceable relative to the lower tray 111. By sliding the upper tray 112, the upper tray 112 can be displaced between a service position and a withdrawn position just as the foregoing upper tray 55 can. A discharged sheet receiving tray 113 is pivotably connected to the lower tray 111.

The discharged sheet receiving tray 113 is provided pivotably about pivot shafts 114 on both sides in the x direction (FIG. 22 shows only a pivot shaft 114 on one side), and is capable of assuming a closed state as shown in FIG. 22, that is, a state for receiving sheets discharged, and an open state (not depicted), that is, a state in which a sheet housing region of the lower tray 111 is opened to a great degree.

Even in the case where an upper tray and a lower tray are provided as an integral body and a discharged sheet receiving tray is connected thereto as described above, the edges of sheets in each tray can be detected from outside a tray sidewall.

Although the discharged sheet receiving tray 113 is provided in connection with the lower tray 111 in the example shown in FIG. 22, the discharged sheet receiving tray 113 may instead be provided in connection with the upper tray 112.

Furthermore, an upper tray or a lower tray may be configured so as not to support various sheet sizes but to support only one sheet size. That is, although in the foregoing exemplary embodiments, each edge guide is provided displaceably in a range so as to support a plurality of sheet sizes, each edge guide may be provided so as to support only one sheet size.

In this case, it is preferable that the edge guides be provided so as to be movable slightly toward an outer side of the tray from the position for guiding the sheet edge so that a user can expand the sheet housing region when setting sheets. This allows sheets to be easily set.

However, if a sheet feeding operation is performed with the edge guide having been moved to the outer sides (without completing a necessary operation for the edge guides), there is a risk of causing a skew of a sheet at the time of sheet feeding.

However, since the control unit of the printer is capable of recognizing the position of the edge guide by the detection unit capable of detecting the distance to the edge guide as described above, the control unit can recognize a failure to complete a necessary operation for the edge guide as mentioned above and therefore can perform an appropriate sheet feeding control. For example, when the edge guide is not at an appropriate position, the control unit can output an alert concerning the inappropriate position of the edge guide.

Furthermore, in the exemplary embodiments described above, the feed roller 9 is provided at a central portion of each tray in the sheet width direction (x direction), which is a direction that intersects the sheet feeding direction. That is, the exemplary embodiments adopt a sheet feeding method with a catered reference position. Therefore, the edge guides are provided so as to be displaceable together in an interlocked manner in such directions that the edge guides move closer to and away from each other, with the reference position being at the central portion of each tray. For example, on the lower tray 50 in the first exemplary embodiment, the edge guides 53A and 53B are provided so as to be displaceable together in an interlocked manner in such directions that the edge guides 53*a* and 53B move closer to and away from each other, with the reference position being at the central portion of each tray in the x direction.

FIG. 23A shows this disposal of the feed roller 9, illustrating a positional relation between the feed roller 9 and the lower tray 50. In FIG. 23A, a line Fs indicates a reference position for sheet feeding, which is set at the central portion of the tray. A friction member 71 is provided at the sheet feeding reference position Fs on a bottom surface 50*a*. The edge guides 53A and 53B are displaced together in an interlocked manner so as to move closer to and away from each other across the sheet feeding reference position Fs.

Therefore, in this case, the edge guide sensor 63A may be provided in either a negative-x-direction side portion of each tray or an opposite side (positive-x-direction side) portion of each tray.

However, in the case where the feed roller 9 is provided relatively near to a sidewall in the sheet width direction (x direction), which intersects the sheet feeding direction, as in the tray 120 shown in FIG. 23B, that is, in the case where sheet feeding is performed based on a one-sided reference position, there are cases where a displaceable edge guide (edge guide 53B) is provided only to one side. Therefore, in this case, the edge guide sensor 63A is provided to the side of the displaceable edge guide 53B.

It should go without saying that other various modifications are also possible.

Although the foregoing exemplary embodiments include a unit that calculates the sheet size in the sheet width direction (x direction), a unit that calculates a sheet size in the sheet feeding direction (y direction) may be further included.

Figure 25:
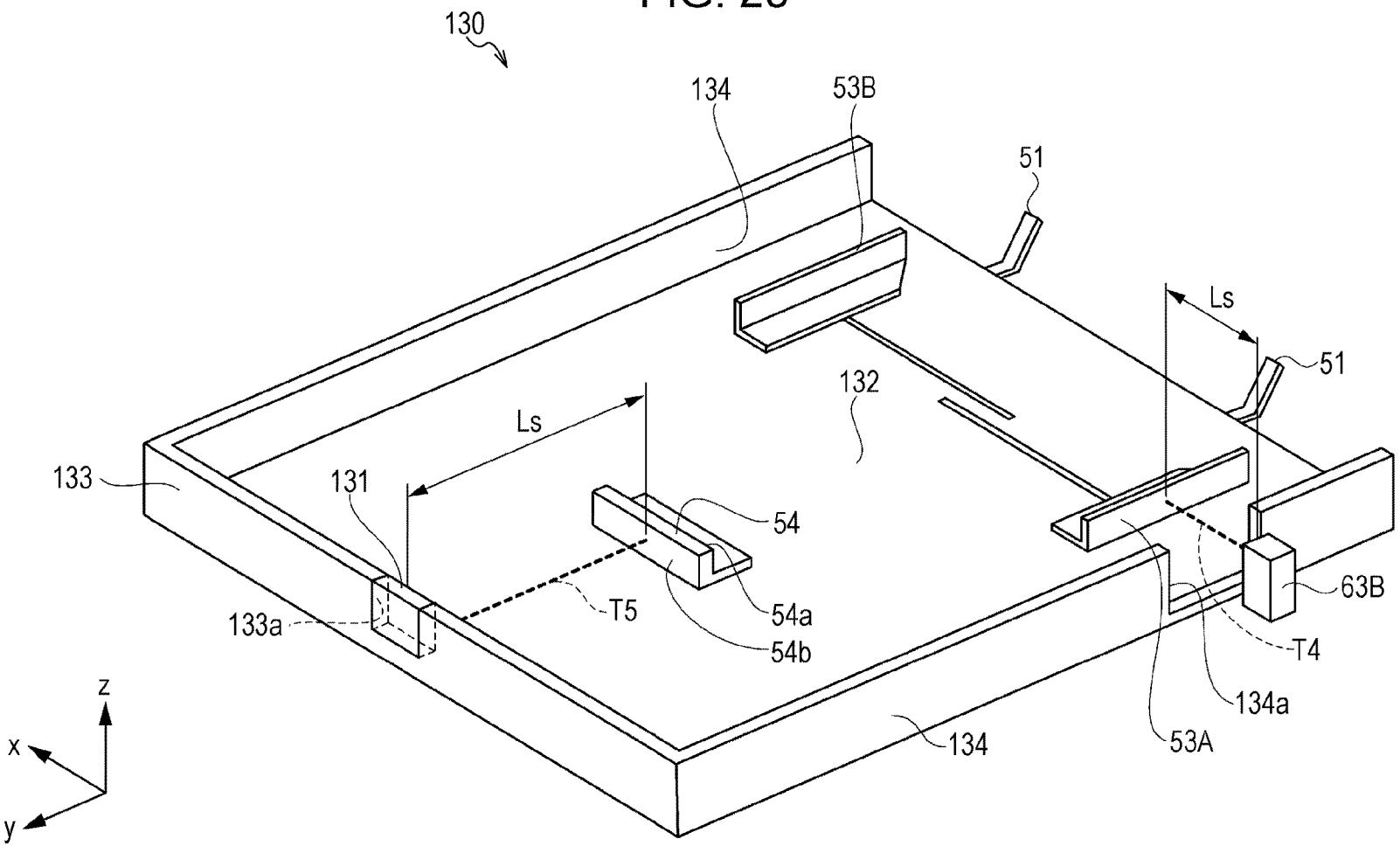
FIG. 25 is a perspective view showing a still further exemplary embodiment of a lower tray.

Referring to FIG. 25, a pair of stoppers 51 is provided on a downstream-side end portion of a lower tray 130 in the sheet feeding direction (a negative-y-direction-side end portion of the lower tray 130). Edge guides 53A and 53B are provided on a bottom wall 132 of the lower tray 130 so as to be displaceable together in an interlocked manner in such directions that the edge guides 53A and 53B move closer to and away from each other, with a reference position being at a central portion of the tray in the sheet width direction. Thus, the edge guides 53A and 53B restrict the positions of edges of sheets in the width direction.

Two end portions of the lower tray 130 in the sheet width direction are provided with tray wall portions 134 that stand from the bottom wall 132 and that extend in the sheet feeding direction. A tray wall portion 134 on one side in the sheet width direction has a cutout portion 134*a*. The cutout portion 134*a* is provided at such a position as to overlap with the edge guide 53A in terms of the sheet feeding direction.

The edge guide sensor 63B is provided on an inner wall of a housing section that houses the lower tray 130 (see FIG. 14). The edge guide sensor 63B is disposed at such a position as to face the edge guide 53A when the lower tray 130 is housed in the housing section.

The edge guide sensor 63B emits toward the edge guide 53A detection light T4 that passes through the cutout portion 134*a* to detect the distance Ls between the edge guide sensor 63B and the edge guide 53A. Based on the detected distance Ls, a control unit (not depicted) calculates the sheet size in the sheet width direction.

An edge guide 54 is provided on the bottom wall 132 so that the position of the edge guide 54 in the sheet feeding direction can be shifted. Therefore, the edge guide 54 restricts, using its guide surface 54*a*, the position of an upstream-side (positive-y-direction-side) edge of the sheets that is a rear end of the sheets.

An upstream-side end portion of the lower tray 130 in the sheet feeding direction is provided with a tray wall portion 133 that stands from the bottom wall 132 and that extends in the sheet width direction. An edge guide sensor 131 is fitted in a cutout portion 133*a* formed in the tray wall portion 133.

The lower tray 130 has a connector portion (not depicted) that is electrically connectable to the control unit (not depicted) that is provided on the apparatus body side. When the lower tray 130 is attached to or detached from the apparatus body (not depicted), the connector portion is correspondingly electrically connected or disconnected.

The edge guide sensor 131 is disposed at a position that faces an opposite wall surface 54*b* of the edge guide 54 to the guide surface 54*a*. The edge guide sensor 131 emits detection light T5 to the wall surface 54*b* to detect the distance Ls between the edge guide sensor 131 and the wall surface 54*b*. Based on the detected distance Ls, the control unit (not depicted) calculates the sheet size in the sheet feeding direction.

Due to the foregoing configuration, the control unit is able to determine whether the sheet size of the "user-defined size" registered via the printer driver in the sheet feeding direction and the sheet size in the sheet feeding direction calculated by using the edge guide sensor 131 match or do not match each other. When it is determined that the sheet sizes do not match, that is, the sheet size calculated by using the edge guide sensor 131 is incorrect, the control unit is able to cause an alert to be displayed.

Furthermore, due to the foregoing configuration, determination regarding standardized sheet sizes can be performed. For example, since the size of the long sides of the A4-size sheets are equal to the size of the short sides of the A3-size sheets, A4-size sheets or A3-size sheets can be housed in the lower tray 130. That is, A4-size sheets can be housed in a lateral placement (the direction of the long sides thereof coinciding with the sheet width direction) and A3-size sheets can be housed in a longitudinal placement (the direction of the short sides thereof coinciding with the sheet width direction).

Since the unit that calculates the sheet size in the width direction and the unit that calculates the sheet size in the sheet feeding direction are provided, it can be determined whether the sheets housed in the lower tray 130 are of the A4 size or the A3 size.

The entire disclosure of Japanese Patent Application No.: 2014-175123, filed Aug. 29, 2014 and 2015-083973, filed Apr. 16, 2015 are expressly incorporated by reference herein.

What is claimed is:

1. A recording apparatus comprising:

a recording unit that performs recording on a medium;

a medium housing section that houses the medium;

an edge guide that is provided in the medium housing section, that is displaceable according to a size of the medium, and that guides an edge of the medium;

a detection unit that is spaced from the edge guide by a gap in a displacement direction of the edge guide and that detects a distance to the edge guide;

a computation unit that computes a position of the edge guide based on a result of detection by the detection unit so as to detect the size of the medium or to detect the amount of the medium housed in the medium housing section; and a feed roller that feeds out the medium from the medium housing section;

wherein the feed roller is provided on a pivotable pivot member and advances toward and withdraws from a bottom surface of the medium housing section as the pivot member pivots, and wherein the detection unit is provided on the pivot member.

2. The recording apparatus according to claim 1, wherein the edge guide is displaceable in a direction that intersects a feeding direction of the medium.

3. The recording apparatus according to claim 2, wherein the edge guide is displaceable in the feeding direction of the medium.

4. The recording apparatus according to claim 1, wherein the detection unit is an optical sensor.

5. The recording apparatus according to claim 4, wherein:

the medium housing section is detachably attachable to an apparatus body that includes the recording unit;

the detection unit is provided on the apparatus body;

a sidewall of the medium housing section is provided with a light passing portion that lets detection light from the optical sensor pass; and the detection unit detects the distance to the edge guide in the medium housing section via the light passing portion of the sidewall.

6. The recording apparatus according to claim 5, wherein the light passing portion is made up of a cutout or a hole.

7. The recording apparatus according to claim 1, wherein the detection unit is provided at such a position as to be able to face a guide surface of the edge guide when the medium is housed up to an upper-limit height in the medium housing section to which the medium is allowed to be housed in the medium housing section.

8. The recording apparatus according to claim 1, comprising a plurality of the medium housing section, wherein the edge guide provided in each of the plurality of the medium housing section is detected by a single one of the detection unit.

9. The recording apparatus according to claim 8, wherein a reflection rate of the detection light emitted from the optical sensor to the edge guide with respect to the edge guide varies from one medium housing section to another among the plurality of the medium housing section.

10. The recording apparatus according to claim 1, wherein a control unit that receives detection information from the detection unit outputs a predetermined alert when the detection unit does not detect the edge guide.

11. The recording apparatus according to claim 1, wherein a control unit that receives detection information from the detection unit outputs a predetermined alert when the distance between the edge guide and the detection unit exceeds a predetermined range.

* * * * *